US007928937B2

(12) United States Patent
Ozaki

(10) Patent No.: US 7,928,937 B2
(45) Date of Patent: Apr. 19, 2011

(54) LIGHT EMITTING DEVICE

(75) Inventor: Tadafumi Ozaki, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 228 days.

(21) Appl. No.: 11/111,884

(22) Filed: Apr. 22, 2005

(65) Prior Publication Data

US 2005/0243079 A1 Nov. 3, 2005

(30) Foreign Application Priority Data

Apr. 28, 2004 (JP) ..... 2004-133712

(51) Int. Cl.
*G09G 3/32* (2006.01)

(52) U.S. Cl. ..... 345/82; 345/76; 345/77

(58) Field of Classification Search ..... 345/204–205, 345/690, 55, 76–77, 80, 82–84, 87
See application file for complete search history.

(56) References Cited

U.S. PATENT DOCUMENTS

| | | | | |
|---|---|---|---|---|
| 6,115,017 | A * | 9/2000 | Mikami et al. | 345/92 |
| 6,249,265 | B1 * | 6/2001 | Tajima et al. | 345/63 |
| 6,448,960 | B1 * | 9/2002 | Shigeta | 345/204 |
| 6,661,180 | B2 * | 12/2003 | Koyama | 315/169.3 |
| 6,870,192 | B2 | 3/2005 | Yamazaki et al. | |
| 6,930,680 | B2 | 8/2005 | Miyazawa | |
| 6,987,496 | B2 * | 1/2006 | Koyama et al. | 345/76 |
| 7,019,717 | B2 | 3/2006 | Yumoto et al. | |
| 7,170,094 | B2 | 1/2007 | Yamazaki et al. | |
| 7,221,351 | B2 | 5/2007 | Senda | |
| 7,236,164 | B2 * | 6/2007 | Kimura | 345/214 |
| 2002/0036604 | A1 * | 3/2002 | Yamazaki et al. | 345/76 |
| 2002/0047852 | A1 | 4/2002 | Inukai et al. | |
| 2003/0071772 | A1 * | 4/2003 | Kimura | 345/76 |
| 2003/0117348 | A1 * | 6/2003 | Knapp et al. | 345/76 |
| 2004/0036683 | A1 * | 2/2004 | Senda | 345/204 |
| 2004/0135779 | A1 * | 7/2004 | Inukai | 345/204 |
| 2004/0252085 | A1 | 12/2004 | Miyagawa | |

(Continued)

FOREIGN PATENT DOCUMENTS

CN 1409402 4/2003

(Continued)

OTHER PUBLICATIONS

Office Action issued in Chinese Application No. 200510076237.9; CN7852 dated Feb. 28, 2008 with English translation, 21 pages.

(Continued)

*Primary Examiner* — Alexander Eisen
*Assistant Examiner* — Jason M Mandeville
(74) *Attorney, Agent, or Firm* — Fish & Richardson P.C.

(57) ABSTRACT

A light emitting device with generation of a pseudo contour suppressed is provided in which the drive frequency of a driver circuit is suppressed while the frame frequency is increased. In addition, a light emitting device with generation of a pseudo contour suppressed is provided in which the drive frequency of a driver circuit is suppressed while the dividing number of a subframe period is increased. To input plural bits of video signals into pixels in parallel, a switching transistor and a driving transistor are provided in each pixel in accordance with the number of the bits. In addition, a transistor for selecting a video signal (a data selecting transistor) is provided in each pixel in order to select each bit of a video signal within the pixel when display is actually performed at the pixels.

6 Claims, 16 Drawing Sheets

U.S. PATENT DOCUMENTS

| | | | | |
|---|---|---|---|---|
| 2004/0263440 | A1 | 12/2004 | Kimura et al. | |
| 2005/0168570 | A1 * | 8/2005 | Kim et al. | 348/71 |
| 2005/0243040 | A1 | 11/2005 | Miyazawa | |
| 2006/0170624 | A1 | 8/2006 | Yumoto et al. | |
| 2006/0220581 | A1 | 10/2006 | Yamazaki et al. | |

FOREIGN PATENT DOCUMENTS

| | | |
|---|---|---|
| CN | 1426041 | 6/2003 |
| CN | 1455914 | 11/2003 |
| CN | 1460985 | 12/2003 |
| EP | 1 321 922 | 6/2003 |
| EP | 1 353 316 | 10/2003 |
| EP | 1 777 692 | 4/2007 |
| JP | 1 184 833 | 3/2002 |
| JP | 2002-149113 | 5/2002 |
| WO | WO 03/089979 | 10/2003 |

OTHER PUBLICATIONS

Chinese Office Action dated Oct. 17, 2008 for Application No. 2005100762379; with English translation, 22 pages.

Office Action issued in Chinese Application No. 200510076237.9; CN7852 dated Feb. 15, 2008 with English translation, 21 pages.

* cited by examiner

LIGHT EMITTING DEVICE

BACKGROUND OF THE INVENTION

1. Field of the Invention

The present invention relates to a light emitting device in which a plurality of pixels each comprises a light emitting element and a means for supplying current to the light emitting element.

2. Description of the Related Art

As a driving method of a light emitting device, there is a time gray scale method in which a gray scale is displayed by controlling a light emitting period of a pixel in one frame period by use of binary voltage of a digital video signal. Electroluminescent materials are more suitable for a time gray scale method than liquid crystals and the like since the response speed is generally faster. Specifically, when displaying by the time gray scale method, one frame period is divided into a plurality of subframe periods. Then, a pixel emits light or does not emit light according to a video signal in each of the subframe periods. According to the aforementioned structure, the total actual light emitting period of a pixel in one frame period can be controlled with a video signal, so that a gray scale can be displayed.

However, in the case of performing display using the time gray scale method, there is a problem in that a pseudo contour may be displayed in a pixel portion depending on the frame frequency. Pseudo counters are unnatural contour lines that are often perceived when a middle gray scale is displayed by the time gray scale method, which is considered to be caused by a variation of the perceptual luminance due to a characteristic of the human sight.

A pseudo contour includes a moving image pseudo contour which occurs when a moving image is displayed, and a still image pseudo contour which occurs when a still image is displayed. The moving image pseudo contour occurs because in contiguous frame periods, a subframe period included in the previous frame period and a subframe period included in the present frame period are perceived as one continuous frame period by human eyes. That is, moving image pseudo contours mean unnatural bright or dark lines displayed in a pixel portion that are perceived by human eyes since the number of gray scales deviates from the number of gray scales to be displayed in the actual frame period. A mechanism for generation of a still image pseudo contour is the same as that of a moving image pseudo contour. The still image pseudo contour occurs when a still image is displayed, because a human view point slightly moves horizontally or vertically at a boundary between regions having the different numbers of gray scales, and thus a moving image seems to be displayed at pixels in the vicinity of the boundary. That is, still image pseudo contours mean unnatural bright or dark lines that occur in a swinging manner in the vicinity of a boundary between regions having the different numbers of gray scales due to a moving image pseudo contour that occurs at pixels in the vicinity of the boundary.

In order to prevent the above-described pseudo contours, it is effective to increase the frame frequency, or to further divide the subframe period into a plurality of frames. Patent Document 1 has been disclosed a technology for preventing light emitting periods of a pixel or of non-light emitting periods of a pixel from occurring continuously by dividing a subframe period into a plurality of frames.

[Patent Document 1] Japanese Patent Laid-Open No. 2002-149113

When a subframe period is divided into a plurality of frames, the larger the dividing number is, the more certainly generation of a pseudo contour can be suppressed. However, the larger the dividing number is, the shorter the divided subframe period is required to be. Similarly, in the case where the frame frequency is increased, each subframe period is required to be shortened as well.

Furthermore, in the case of an active matrix type light emitting device, it is necessary to input a video signal into pixels at all rows for each subframe period or divided subframe period. Therefore, if subframe periods or divided subframe periods are shortened, the next subframe period or divided subframe period starts before video signal input for all rows in a pixel portion is completed. However, in active matrix type light emitting devices generally, each pixel comprises a light emitting element, a transistor for controlling video signal input into the pixel (switching transistor), and a transistor for controlling a current value supplied to the light emitting element (driving transistor). Consequently, it is impossible to input video signals into the pixels at two or more rows in the pixel portion in parallel.

Therefore, the drive frequency of a driver circuit is required to be increased such that video signal input at all rows in a pixel portion is completed before the next subframe period or divided subframe period starts even if the subframe period or divided subframe period is shortened. From the viewpoint of reliability of a driver circuit, however, it is not preferable to increase the drive frequency more than is necessary.

SUMMARY OF THE INVENTION

In view of the foregoing problem, it is an object of the invention to provide a light emitting device with generation of a pseudo contour suppressed by suppressing the drive frequency of a driver circuit while increasing the frame frequency. In addition, it is an object of the invention to provide a light emitting device with generation of a pseudo contour suppressed by suppressing the drive frequency of a driver circuit while increasing the dividing number of a subframe period.

The present inventor considers as follows: Instead of inputting video signals into pixels at two or more rows in parallel, plural bits of video signals are inputted into pixels at one row in parallel so that subframe periods or divided subframe periods can be shortened.

According to the invention, in order to input plural bits of video signals into pixels in parallel, switching transistors and driving transistors are provided in each pixel in accordance with the number of bits. In addition, in order to select each bit of a video signal within the pixel when display is actually performed at the pixels, a transistor for selecting a video signal (data selecting transistor) is provided in each pixel.

A light emitting device of the invention comprises a light emitting element, n switching transistors for controlling video signals input into a pixel, n driving transistors of which gate-source voltages are controlled by voltages of the inputted video signals, and a plurality of data selecting transistors for controlling supply of drain current of one of the n driving transistors to the light emitting element.

It is to be noted that the number of the data selecting transistors is not restricted as long as supply of drain current of one of the n driving transistors to the light emitting element can be controlled.

According to the above-described configuration, n bits of video signals can be inputted into a pixel in parallel. Furthermore, in the invention, after the video signals are inputted into the pixel, the video signals are sequentially selected by the data selecting transistors, so that the light emitting element can emit light or not sequentially in accordance with each bit of the video signal.

In this specification, light emitting elements include an element of which luminance is controlled by current or voltage, specifically such as an OLED (Organic Light Emitting Diode), a MIM type electron source element (electron emitting element) used in an FED (Field Emission Display), and the like.

An OLED (Organic Light Emitting Diode), which is a light emitting element, includes a layer containing an electroluminescent material (hereinafter, referred to as an "electroluminescent layer") that can generate luminescence (Electroluminescence) when an electric field is applied thereto, an anode, and a cathode. The electroluminescent layer is provided between the anode and the cathode, which is structured by a single layer or a plurality of layers. These layers may include an inorganic compound. Luminescence in the electroluminescent layer includes emission (fluorescence) generated when returning to a ground state from a singlet excitation state, and emission (phosphorescence) generated when returning to a ground state from a triplet excitation state.

In this specification, one of the anode and the cathode of which potential can be controlled by a driving transistor is referred to as a first electrode, and the other is referred to as a second electrode.

In addition, the light emitting device includes a panel with a light emitting element sealed, and a module where an IC and the like including a controller are mounted on the panel. The invention further relates to an element substrate that is one mode where a light emitting element is not yet completed in a manufacturing process of the light emitting device.

Specifically, the element substrate may be in any mode such that only a first electrode of a light emitting element has been formed, or alternatively, a conductive film to be a first electrode has been formed but not yet patterned to form the first electrode.

For a transistor in the light emitting device of the invention, a thin film transistor using a polycrystalline semiconductor, a microcrystalline semiconductor (including a semi-amorphous semiconductor), or an amorphous semiconductor can be used, however, a transistor in the light emitting device of the invention is not limited to a thin film transistor. A transistor using single crystalline silicon or a transistor employing an SOI may be used. In addition, a transistor using an organic semiconductor or a carbon nanotube transistor may be used. Furthermore, a transistor provided in a pixel of the light emitting device of the invention may have a single-gate structure, a double-gate structure, or a multi-gate structure that includes more than two gates.

A Semi-amorphous semiconductor has an intermediate structure between amorphous and crystalline (including single crystalline and polycrystalline) structures. The semi-amorphous semiconductor has a third state that is stable in free energy, and has a short range order and a lattice distortion, in which crystals each having a particle size of 0.5 to 20 nm can be dispersed in a non-single crystalline semiconductor. In the semi-amorphous semiconductor, Raman spectrum is shifted to the lower frequency band than 520 $cm^{-1}$ and diffraction peaks of (111) and (220) derived from a Si crystal lattice are observed by X-ray diffraction. Further, the semiconductor is mixed with at least 1 atom % of hydrogen or halogen as a neutralizing agent for dangling bond. Such a semiconductor is called herein a semi-amorphous semiconductor (SAS). A favorable semi-amorphous semiconductor with improved stability can be obtained by further promoting the lattice distortion by mixing rare gas elements such as helium, argon, krypton, and neon.

According to the above-described structure of the invention, plural bits of video signals can be inputted into each row in a pixel portion in parallel, and the inputted plural bits of video signals are selected sequentially to perform display. Therefore, even if a subframe period or a divided subframe period is set to be shorter than a period for inputting video signals into all rows in a pixel portion, input of video signals into pixels at two or more rows in parallel is not required in the pixel portion, and the drive frequency of a driver circuit is not required to be increased more than is necessary.

In this manner, in a light emitting device of the invention, the drive frequency of a driver circuit is suppressed while the frame frequency is increased, whereby generation of a pseudo contour can be suppressed. In addition, in a light emitting device of the invention, the drive frequency of a driver circuit is suppressed while the dividing number of a subframe period is increased, whereby generation of a pseudo contour can be suppressed.

DETAILED DESCRIPTION OF THE INVENTION

Although the invention will be fully described by way of Embodiment Modes with reference to the accompanying drawings, it is to be understood that various changes and modifications will be apparent to those skilled in the art. Therefore, unless such changes and modifications depart from the scope of the invention, they should be construed as being included therein.

A light emitting device of the invention comprises a light emitting element, n switching transistors for controlling video signals input into a pixel, n driving transistors of which gate-source voltages are controlled by voltages of the inputted video signals, and a plurality of data selecting transistors for controlling supplies of drain currents of one of the n driving transistors to the light emitting element.

Figure 1:
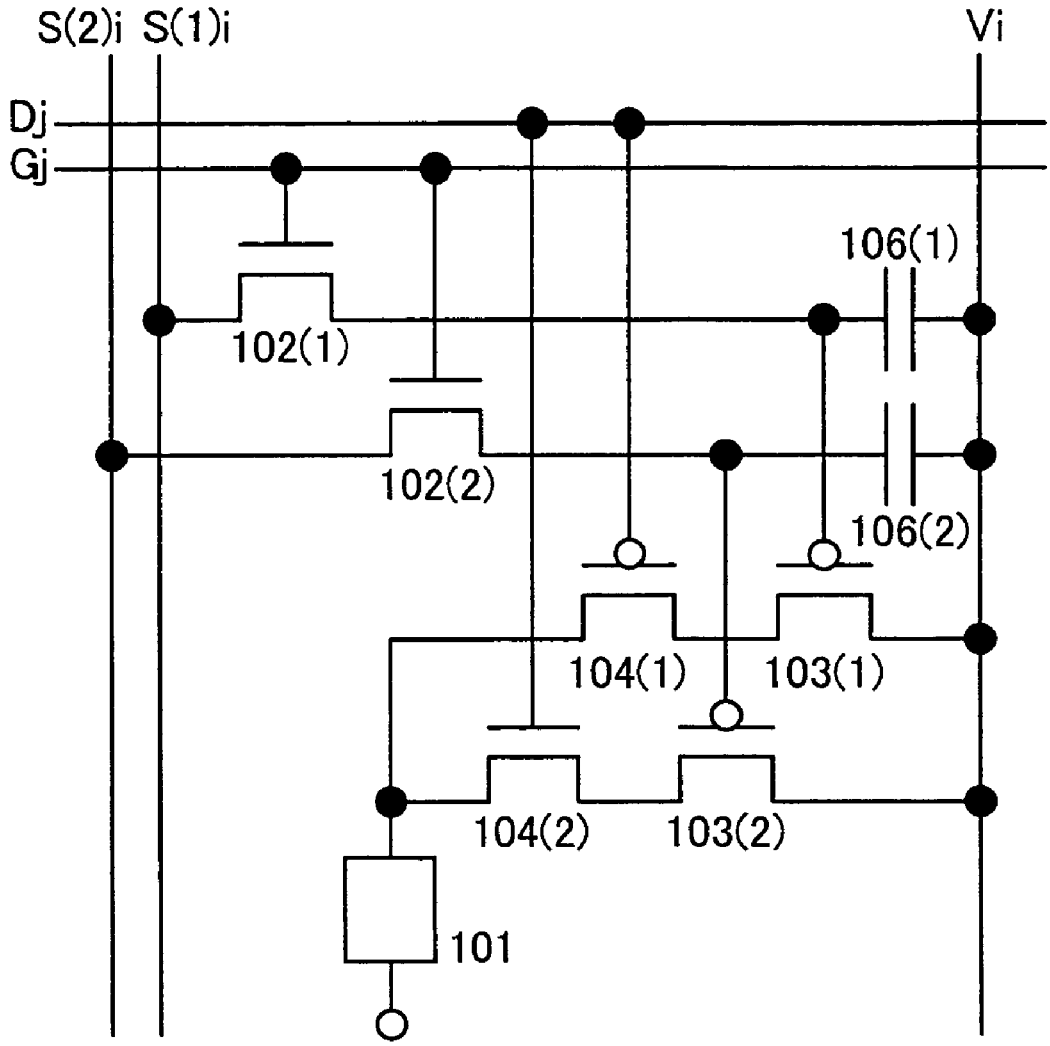
FIG. 1 is a circuit diagram of a pixel in the light emitting device of the invention.

A circuit diagram of FIG. 1 shows one mode of a pixel used in the light emitting device of the invention where n=2. The pixel shown in FIG. 1 includes a light emitting element 101, a first switching transistor 102(1), a second switching transistor 102(2), a first driving transistor 103(1), a second driving transistor 103(2), a first data selecting transistor 104(1), a second data selecting transistor 104(2), a first capacitor 106(1), and a second capacitor 106(2).

The light emitting element 101 has an anode, a cathode, and an electroluminescent layer that is provided between the anode and the cathode. One of the anode and the cathode is employed as a first electrode, and the other is employed as a second electrode.

Gates of the first switching transistor 102(1) and the second switching transistor 102(2) are connected to a scan line Gj (j=1 to y) that is one of scan lines G1 to Gy. One of a source and a drain of the first switching transistor 102(1) is connected to a first signal line S(1)i (i=1 to x) that is one of first signal lines S(1)1 to S(1)x, and the other thereof is connected to a gate of the first driving transistor 103(1). One of a source and a drain of the second switching transistor 102(2) is connected to a second signal line S(2)i (i=1 to x) that is one of second signal lines S(2)1 to S(2)x, and the other thereof is connected to a gate of the second driving transistor 103(2).

In addition, the first driving transistor 103(1) and the first data selecting transistor 104(1) are connected to a power supply line Vi (i=1 to x) that is one of power supply lines VI to Vx, and the light emitting element 101 such that current from the power supply line Vi is supplied to the light emitting element 101 as drain current of the first driving transistor 103(1) and the first data selecting transistor 104(1).

In FIG. 1 specifically, a source of the first driving transistor 103(1) is connected to the power supply line Vi while a drain thereof is connected to a source of the first data selecting transistor 104(1). A drain of the first data selecting transistor 104(1) is connected to the first electrode of the light emitting element 101.

Meanwhile, the second driving transistor 103(2) and the second data selecting transistor 104(2) are connected to the power supply line Vi, and the light emitting element 101 such that current from the power supply line Vi is supplied to the light emitting element 101 as drain current of the second driving transistor 103(2) and the second data selecting transistor 104(2).

In FIG. 1 specifically, a source of the second driving transistor 103(2) is connected to the power supply line Vi while a drain thereof is connected to a source of the second data selecting transistor 104(2). A drain of the second data selecting transistor 104(2) is connected to the first electrode of the light emitting element 101.

Gates of the first data selecting transistor 104(1) and the second data selecting transistor 104(2) are connected to a selecting line Dj (j=1 to y) that is one of selecting lines D1 to Dy.

Note that the first capacitor 106(1) and the second capacitor 106(2) are not necessarily provided. In FIG. 1, one of two electrodes of the first capacitor 106(1) is connected to the gate of the first driving transistor 103(1), and the other thereof is connected to the power supply line Vi. One of two electrodes of the second capacitor 106(2) is connected to the gate of the second driving transistor 103(2), and the other thereof is connected to the power supply line Vi.

Between the power supply line Vi and the second electrode of the light emitting element 101, voltage is applied so as to supply forward biased current to the light emitting element 101 when the power supply line Vi and the second electrode of the light emitting element 101 are electrically connected.

Figure 7:
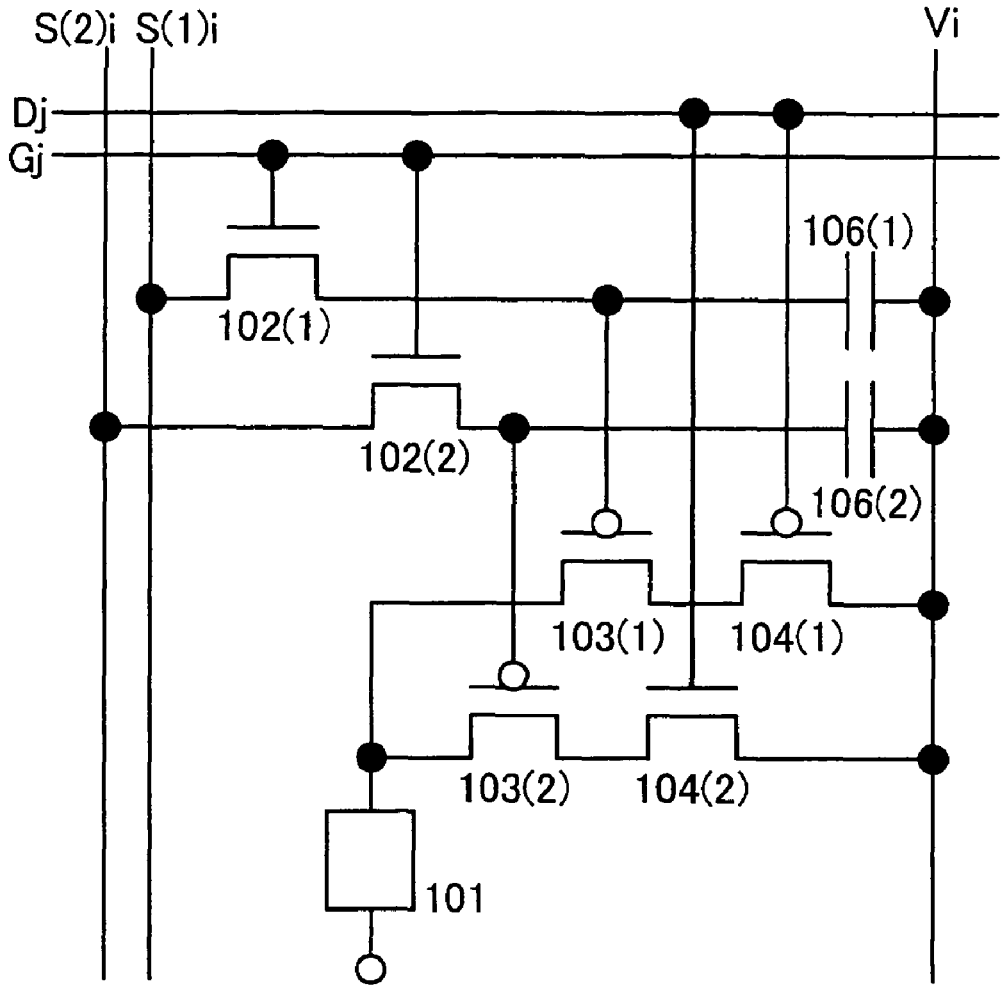
FIG. 7 is a circuit diagram of a pixel in the light emitting device of the invention.

Although the first driving transistor 103(1) is connected between the first data selecting transistor 104(1) and the power supply line Vi in FIG. 1, the invention is not limited to this configuration. Similarly, although the second driving transistor 103(2) is connected between the second data selecting transistor 104(2) and the power supply line Vi in FIG. 1, the invention is not limited to this configuration. As shown in FIG. 7, it is possible to connect the first data selecting transistor 104(1) between the first driving transistor 103(1) and the power supply line Vi. In addition, it is possible to connect the second data selecting transistor 104(2) between the second driving transistor 103(2) and the power supply line Vi.

Furthermore, although the pixel includes the first data selecting transistor 104(1) and the second data selecting transistor 104(2) in FIG. 1, the number of data selecting transistors is not limited to two so long as it is n or more per pixel.

In addition, although the first data selecting transistor 104(1) is a P-channel type whereas the second data selecting transistor 104(2) is an N-channel type, the invention is not limited to this configuration. As shown in FIG. 1, in the case where the gates of the first data selecting transistor 104(1) and the second data selecting transistor 104(2) are connected to the one selecting line Dj, it is required that the first data selecting transistor 104(1) and the second data selecting transistor 104(2) have different conductivity. Therefore, in FIG. 1, it is possible that the first data selecting transistor 104(1) is an N-channel type and the second data selecting transistor 104(2) is a P-channel type.

Figure 8:
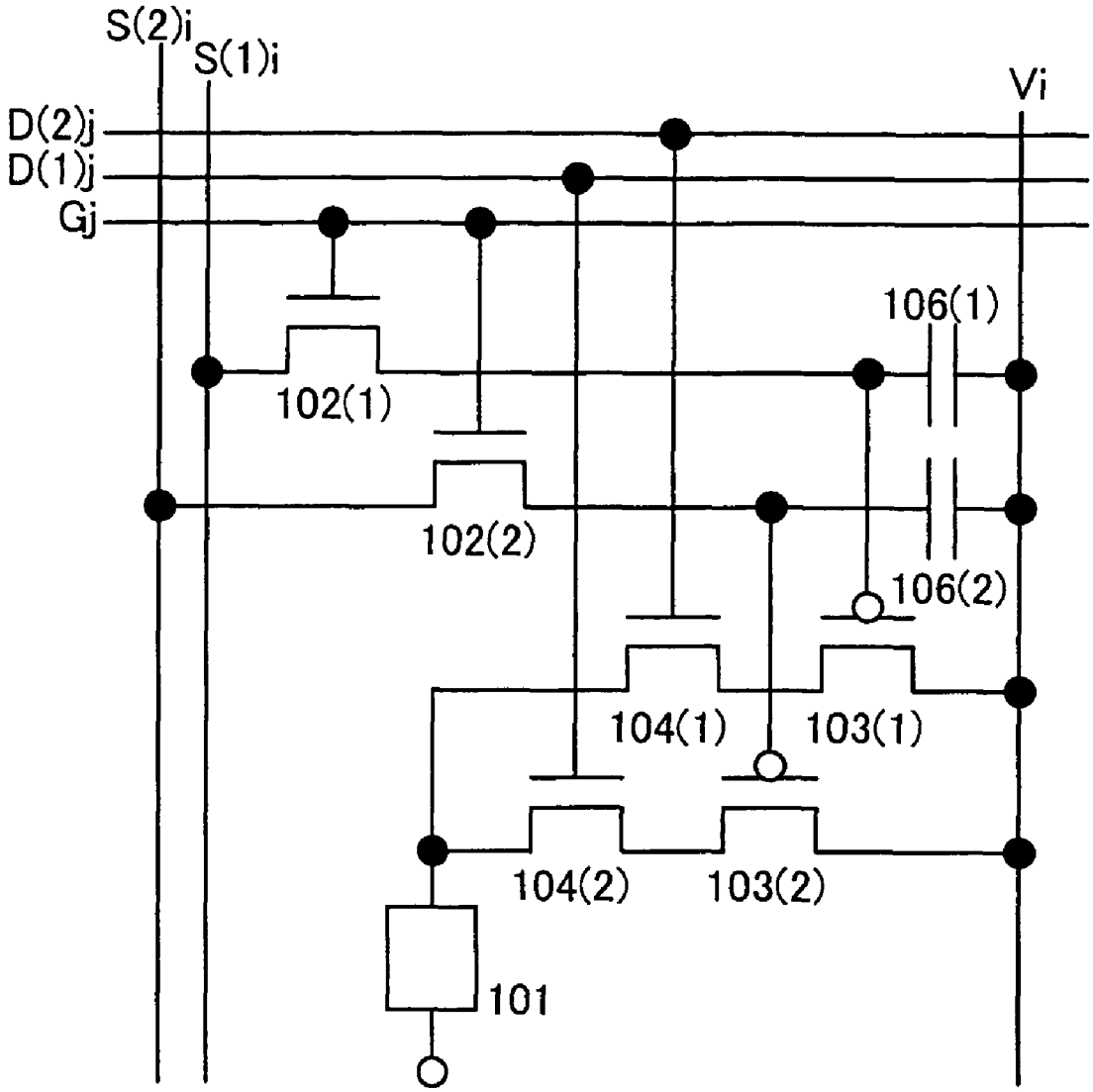
FIG. 8 is a circuit diagram of a pixel in the light emitting device of the invention.

In the invention, all the gates of the plurality of data selecting transistors are not necessarily connected to one selecting line unlike FIG. 1. In the case where the gate of the first data selecting transistor 104(1) and the gate of the second data selecting transistor 104(2) are connected to different selecting lines that are a first selecting line D(1)j and a second selecting line D(2)j respectively as shown in FIG. 8, the conductivity of the first data selecting transistor 104(1) and the second data selecting transistor 104(2) may be the same or different.

In addition, although the first switching transistor 102(1) and the second switching transistor 102(2) are N-channel types in FIG. 1, the invention is not limited to this configuration so long as they have the same conductivity. Therefore, the first switching transistor 102(1) and the second switching transistor 102(2) may be P-channel types. However, in the case where the gates of the plurality of switching transistors in the pixel are connected to different scan lines respectively, not all the switching transistors are required to have the same conductivity.

Furthermore, although the first driving transistor 103(1) and the second driving transistor 103(2) are P-channel types in FIG. 1, the invention is not limited to this configuration. The first driving transistor 103(1) and the second driving transistor 103(2) may be N-channel types. Note that in the case where the first driving transistor 103(1) and the second driving transistor 103(2) are P-channel types, it is preferable that the first electrode of the light emitting element 101 be an anode while the second electrode thereof be a cathode. Whereas, in the case where the first driving transistor 103(1) and the second driving transistor 103(2) are N-channel types, it is preferable that the first electrode of the light emitting element 101 be a cathode while the second electrode thereof be an anode.

Operation of the pixel shown in FIG. 1 is described below. In the light emitting device of the invention, one frame period is divided into a plurality of subframe periods to operate. In addition, in the light emitting device of the invention, one subframe period may be further divided into a plurality of frames to operate. When focusing on n consecutive subframe periods or n divided subframe periods, operation of the pixel can be describes separately divided into a writing period and a holding period. The n divided subframe periods means that the number of subframe periods becomes n by dividing at least one of the subframe periods.

Figure 2A:
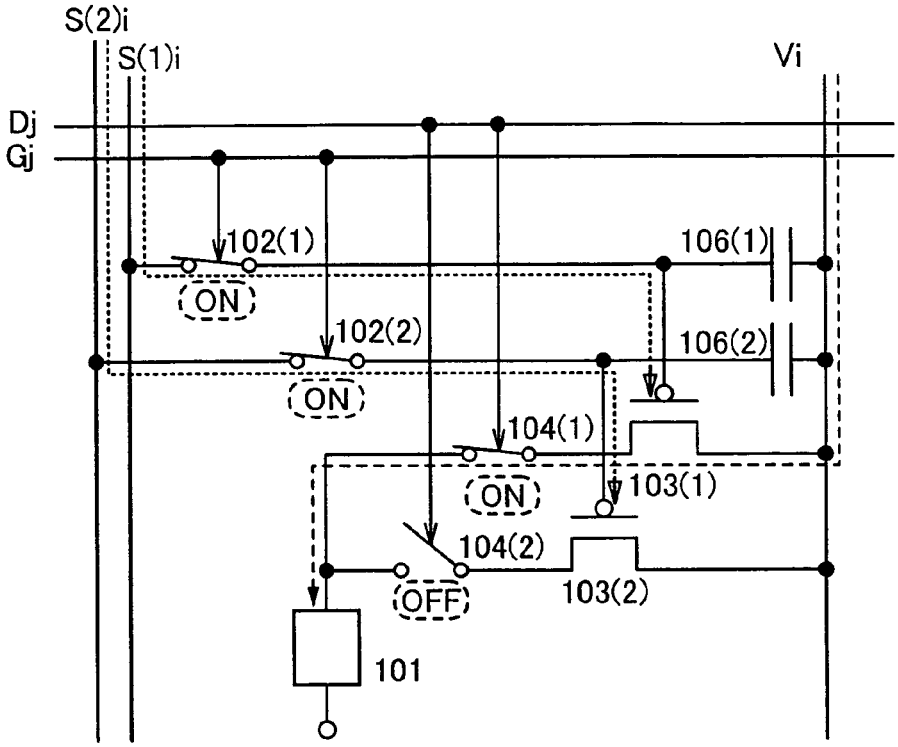
FIGS. 2A and 2B are diagrams each illustrating an operation of the pixel shown in FIG. 1.

FIG. 2A shows operation of the pixel in a writing period. Note here that the first switching transistor 102(1), the second switching transistor 102(2), the first data selecting transistor 104(1), and the second data selecting transistor 104(2) are simply shown as switches in FIGS. 2 and 3 for easy understanding of the pixel operation.

In the writing period, the scan lines G1 to Gy are sequentially selected. When the scan line Gj is selected, the first switching transistor 102(1) and the second switching transistor 102(2), whose gates are connected to the scan line Gj, are turned ON. Then a video signal inputted into the first signal line S(1)i is inputted into the gate of the first driving transistor 103(1) through the first switching transistor 102(1) that is ON. Similarly, a video signal inputted into the second signal line S(2)i is inputted into the gate of the second driving transistor 103(2) through the second switching transistor 102(2) that is ON.

Note that according to the invention, a video signal inputted into the first signal line S(1)i and a video signal inputted into the second signal line S(2)i can be a different bit from each other. For example, in FIG. 2A, the k-th bit of a video signal is inputted into the first signal line S(1)i and the t-th bit of a video signal is inputted into the second signal line S(2)i.

In addition, in the writing period, a signal for turning ON one of the plurality of data selecting transistors is inputted into the selecting lines D1 to Dy sequentially. Specifically, in FIG. 2A, a signal is inputted into the selecting line Dj, thereby the first data selecting transistor 104(1) is turned ON whereas the second data selecting transistor 104(2) is turned OFF.

When the first driving transistor 103(1) is turned ON in accordance with voltage of the k-th bit of a video signal, the power supply line Vi and the first electrode of the light emitting element 101 are electrically connected, thereby forward biased current is supplied to the light emitting element 101. The current supplied to the light emitting element 101 is determined by drain current of the first driving transistor 103(1) and the voltage-current characteristic of the light emitting element 101. The light emitting element 101 emits light with luminance corresponding to the current. On the other hand, when the first driving transistor 103(1) is turned OFF in accordance with voltage of the k-th bit of a video signal, current supply to the light emitting element 101 stops, thereby the light emitting element 101 does not emit light.

Figure 2B:
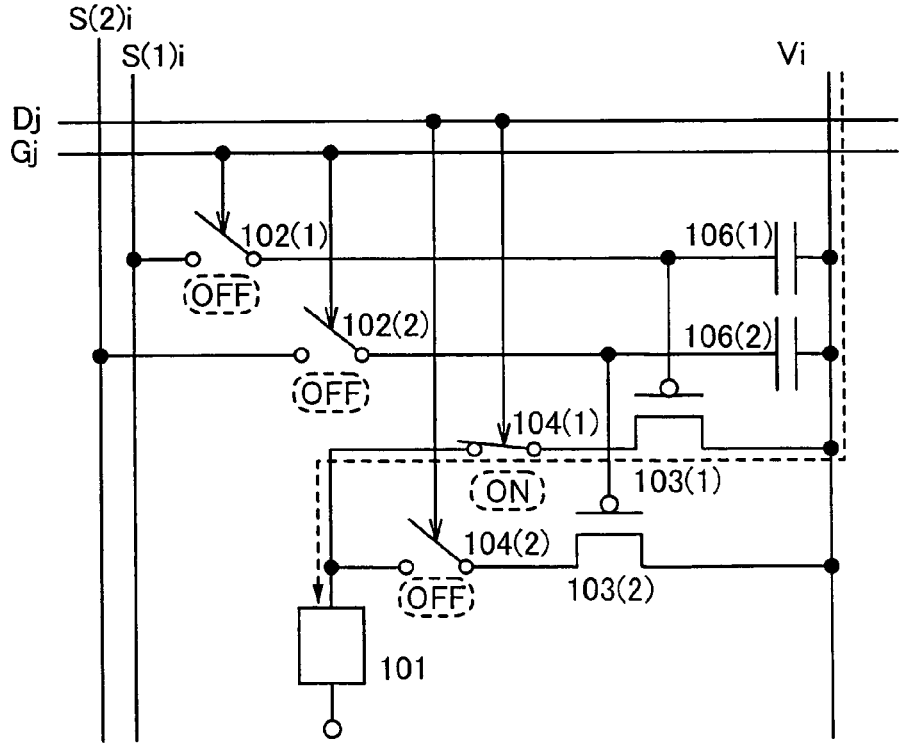

Following the writing period, a holding period starts. During n subframe periods or divided subframe periods, n holding periods are provided. Thus, when n=2, the first holding period and the second holding period occur. First, FIG. 2B shows the pixel operation in the first holding period.

In holding periods, selection of the scan line Gj has been completed, thereby the first switching transistor 102(1) and the second switching transistor 102(2) are turned OFF. In addition, the voltage of the video signal that has been inputted into the pixel in the writing period is held by the first capacitor 106(1) and the second capacitor 106(2) in the holding period.

In the first holding period, the first data selecting transistor 104(1) is kept ON whereas the second data selecting transistor 104(2) is kept OFF by a signal inputted into the selecting line Dj. Therefore, in the case where the first driving transistor 103(1) is turned ON in the writing period, the light emitting element 101 continues to emit light in the first holding period since the first driving transistor 103(1) is kept ON. On the contrary, in the case where the first driving transistor 103(1) is turned OFF in the writing period, the light emitting element 101 continues to emit no light in the first holding period since the first driving transistor 103(1) is kept OFF.

Figure 3:
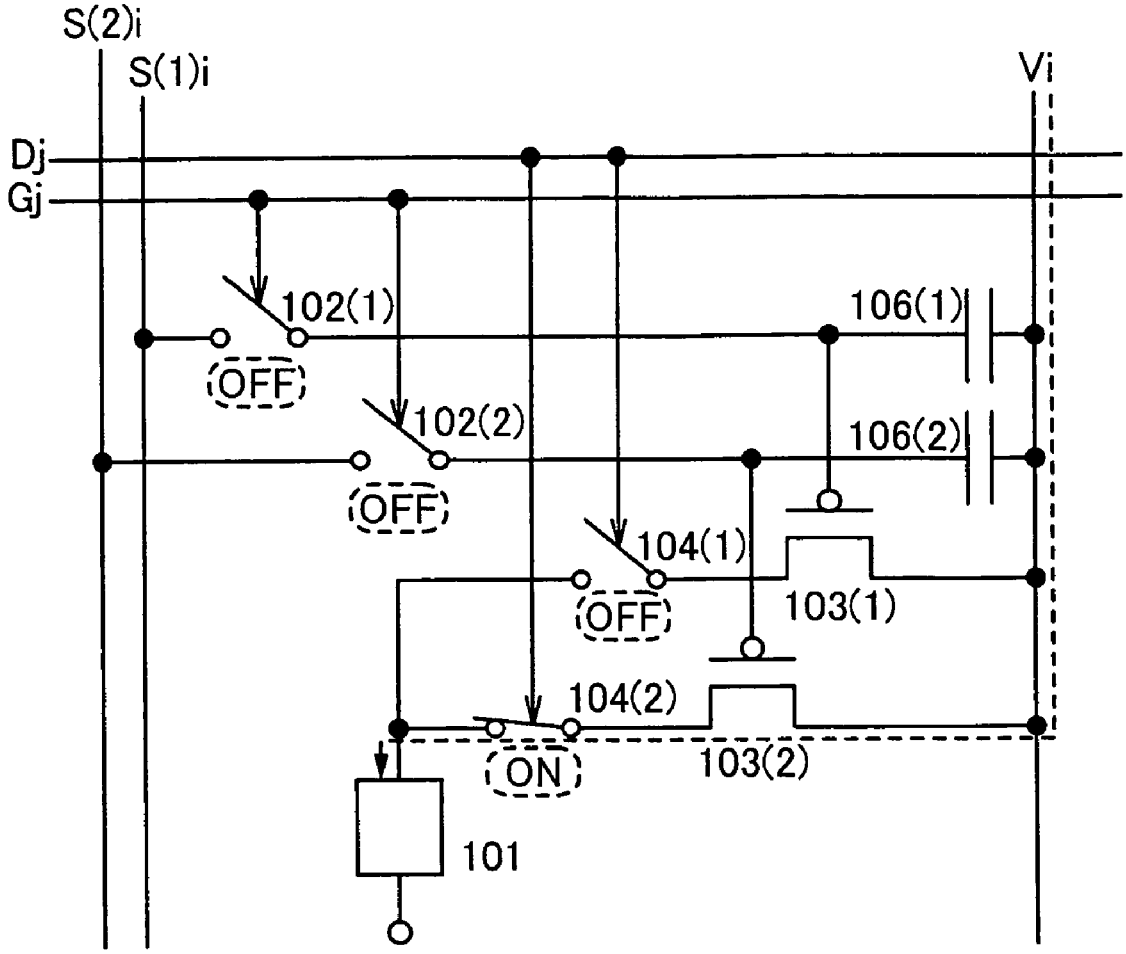
FIG. 3 is a diagram illustrating an operation of the pixel shown in FIG. 1.

FIG. 3 shows operation of the pixel in the second holding period. In the second holding period, only one data selecting transistor other than that of the first holding period is turned ON by a signal inputted into the selecting line Dj. Specifically, in FIG. 3, the first data selecting transistor 104(1) is turned OFF whereas the second data selecting transistor 104(2) is turned ON.

When the second driving transistor 103(2) is turned ON in accordance with voltage of the s-th bit of a video signal, the power supply line Vi and the first electrode of the light emitting element 101 are electrically connected, thereby forward biased current is supplied to the light emitting element 101. The current supplied to the light emitting element 101 is determined by drain current of the second driving transistor 103(2) and the voltage-current characteristic of the light emitting element 101. The light emitting element 101 emits light with luminance corresponding to the current. On the other hand, when the second driving transistor 103(2) is turned OFF in accordance with voltage of the s-th bit of a video signal, current supply to the light emitting element 101 stops, thereby the light emitting element 101 does not emit light.

According to the above-described series of operations, n subframe periods or n divided subframe periods can appear consecutively. Specifically, in FIGS. 2 and 3, the writing period and the first holding period correspond to a subframe period or a divided subframe period for the k-th bit of a video signal. The second holding period corresponds to a subframe period or a divided subframe period for the s-th bit of a video signal.

By appearing all of the subframe periods or all of the divided subframe periods of one frame period, an image with gray levels can be displayed. The number of gray levels can be determined by controlling the total of subframe periods or the total of divided subframe periods where the light emitting element emits light within one frame period.

Note that in the above-described operation, light emission of the light emitting element 101 is controlled in accordance with a video signal, however, the invention is not limited to this. For example, instead of depending on a video signal, a non-display period may be provided where current supply to the light emitting element 101 is stopped and the light emitting elements 101 in all pixels are forced to emit no light.

The non-display period can be obtained by inputting a signal for forcibly turning OFF a driving transistor into a signal line instead of a video signal in a writing period such that a light emitting element is forced to emit no light in a corresponding holding period. Specifically, in the non-display period, a signal (blank) for turning OFF the first driving transistor 103(1) or the second driving transistor 103(2) is inputted into the first signal line S(1)i or the second signal line S(2)i in a writing period. Accordingly, the light emitting element 101 can be made emit no light forcibly in the first holding period or the second holding period.

Note that the non-display period is not necessarily provided. The non-display period is required in the case where the total of n subframe periods or divided subframe periods each appearing sequentially is shorter than a period for inputting a video signal into all rows in a pixel portion. By providing the non-display period, video signal input into pixels at two or more rows in parallel is not required in the pixel portion.

Conventionally, the non-display period has been required in the case where each of subframe periods or divided subframe periods is shorter than a period for inputting a video signal into all rows in a pixel portion. Thus, compared with the conventional technology, according to the invention, the total non-display period within one frame period can be shortened as much as possible even with the same drive frequency. Consequently, duty ratio can be increased, thereby the image contrast displayed in the display portion can be enhanced.

Figure 4:
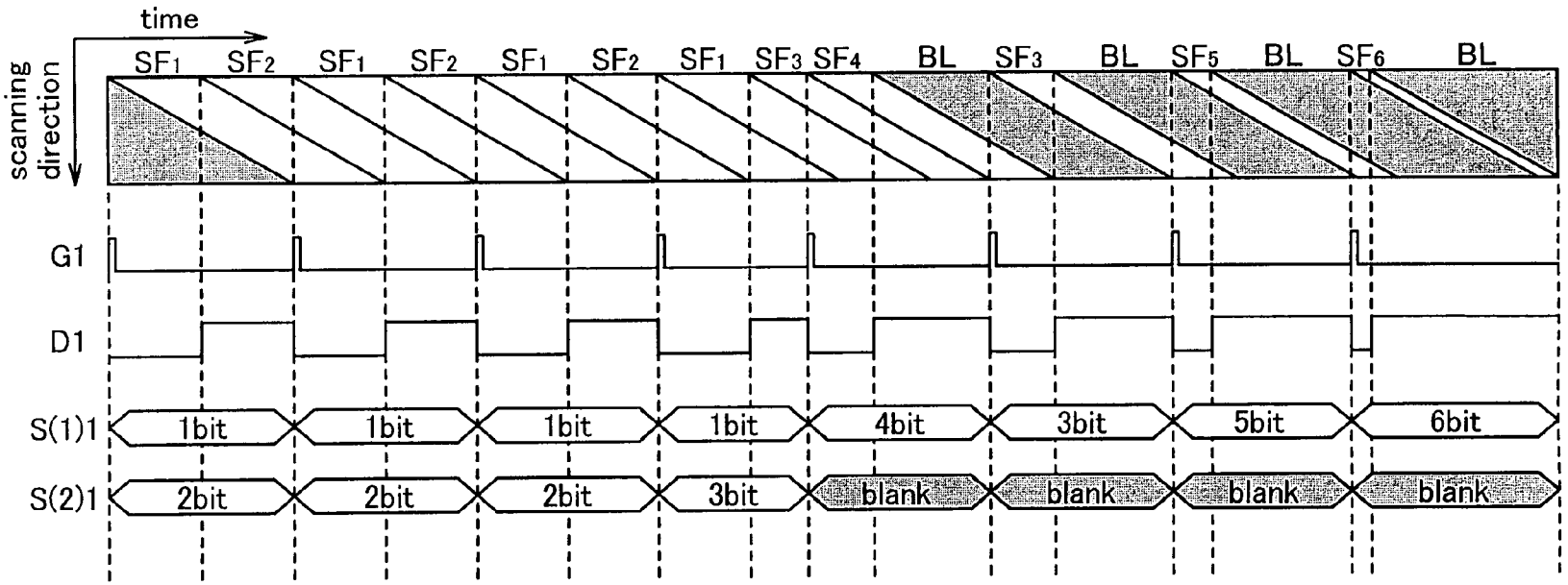
FIG. 4 is timing charts illustrating operation of the pixel shown in FIG. 1.

FIG. 4 is a timing chart in the case of a 6-bit gray scale display using the pixel shown in FIG. 1. In FIG. 4, the horizontal axis indicates the length of subframe periods or divided subframe periods ($SF_1$ to $SF_6$) within one frame period, and the vertical axis indicates the selection sequence of scan lines. In the case where 64 gray scales are displayed using a 6-bit video signal, at least 6 subframe periods are required. In addition, in the case where the gray level is varied linearly, the length ratio of the six subframe periods ($SF_1$ to $SF_6$) is set to be $2^5$: $2^4$: $2^3$: $2^2$: $2^1$: $2^0$.

Note that in FIG. 4, the subframe period $SF_1$ is divided into 4, the subframe period $SF_2$ is divided into 3, and the subframe period $SF_3$ is divided into 2. However, the invention is not limited to this, the subframe period is not necessarily divided, and if it is divided, the dividing number is not limited to those shown in FIG. 4.

In addition, in FIG. 4, timing charts of signals inputted into the scan line G1 and the selecting line D1 in each of the subframe periods are shown respectively. Timing of signals inputted into the first signal line S(1)1 and the second signal line S(2)1 are also shown respectively.

In FIG. 4, first, the first and the second bits of video signals of a 6-bit video signal are inputted into pixels from the first row, and one of divided subframe periods $SF_1$ and one of divided subframe periods $SF_2$ appear sequentially. Then, the first and the second bits of the video signals are inputted into the pixels from the first row again, and one of divided subframe periods $SF_1$ and one of divided subframe periods $SF_2$ appear sequentially. The first and the second bits of the video signals are inputted into the pixels from the first row again, and one of divided subframe periods $SF_1$ and one of divided subframe periods $SF_2$ appear sequentially. Subsequently, the first and the third bits of video signals are inputted into the pixels from the first row, and one of divided subframe periods $SF_1$ and one of divided subframe periods $SF_3$ appear sequentially. Next, the fourth bit of a video signal and a blank signal (blank) for forcibly making a light emitting element emit no light are inputted into the pixels from the first row, and the subframe period $SF_4$ and a non-display period (BL) appear sequentially. Then, the third bit of the video signal and the blank signal (blank) for forcibly making a light emitting element emit no light are inputted into the pixels from the first row, and one of divided subframe periods $SF_3$ and a non-display period (BL) appear sequentially. The fifth bit of a video signal and the blank signal (blank) for forcibly making a light emitting element emit no light are inputted into the pixels from the first row, and the subframe period $SF_5$ and a non-display period (BL) appear sequentially. Then, the sixth bit of a video signal and the blank signal (blank) for forcibly making a light emitting element emit no light are inputted into the pixels from the first row, the subframe period $SF_6$ and a non-display period (BL) appear sequentially.

Note that FIG. 4 illustrates operation of the pixel shown in FIG. 1, however, a pixel of the invention is not limited to the case where n=2. The number of n may be set, such that the total non-display period within one frame period is as short as possible and it may be 0 in the end.

Figure 5:
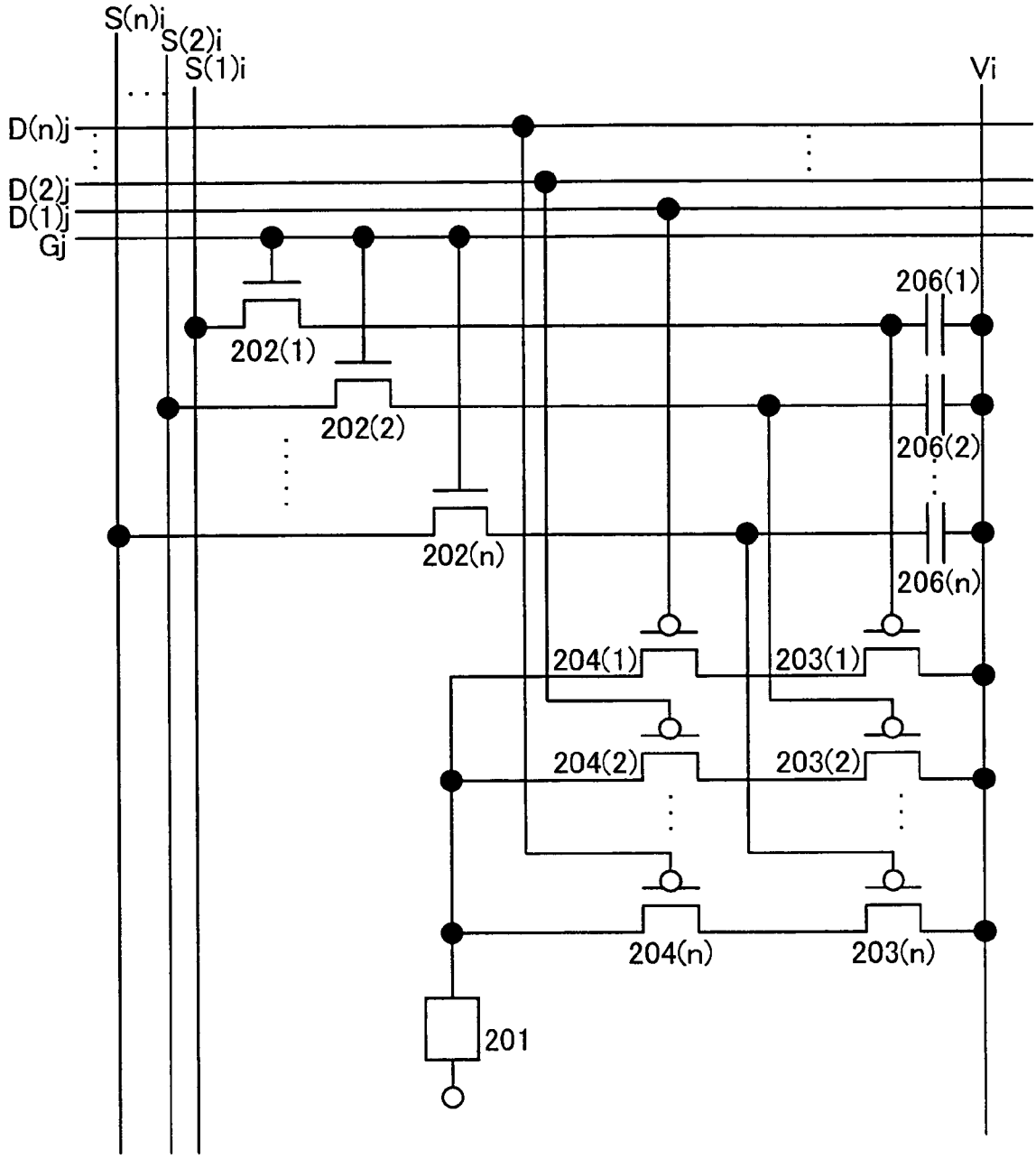
FIG. 5 is a circuit diagram of a pixel in the light emitting device of the invention.

FIG. 5 is a circuit diagram showing one mode of a pixel in the light emitting device of the invention where n is generalized. The pixel shown in FIG. 5 includes a light emitting element 201, first to n-th switching transistors 202(1) to 202(*n*), first to n-th driving transistors 203(1) to 203(*n*), first to n-th data selecting transistors 204(1) to 204(*n*), and first to n-th capacitors 206(1) to 206(*n*).

The light emitting element 201 has an anode, a cathode, and an electroluminescent layer that is provided between the anode and the cathode. One of the anode and the cathode is employed as a first electrode, and the other is employed as a second electrode.

Gates of the first to n-th switching transistors 202(1) to 202(*n*) are connected to the scan line Gj (j=1 to y). One of a source and a drain each of the first to n-th switching transistors 202(1) to 202(*n*) is connected to each of the first to n-th signal lines S(1)i to S(n)i (i=1 to x), and the other thereof is connected to each of gates of the first to n-th driving transistors 203(1) to 203(*n*).

The first to n-th driving transistors 203(1) to 203(*n*) and the first to n-th data selecting transistors 204(1) to 204(*n*) are make pairs with each other. That is, the first driving transistor 203(1) and the first data selecting transistor 204(1) make a pair with each other, the second driving transistor 203(2) and the second data selecting transistor 204(2) make a pair with each other, . . . , and the n-th driving transistor 203(*n*) and the n-th data selecting transistor 204(*n*) make a pair with each other. Furthermore, the pair of the driving transistor and the data selecting transistor is connected to the power supply line Vi and the light emitting element 201 such that current from the power supply line Vi is supplied to the light emitting element 201 as drain current of the pair of the driving transistor and the data selecting transistor.

Gates of the first to n-th data selecting transistors 204(1) to 204(*n*) are connected to the first selecting lines D(1)j to D(n)j (j=1 to y) respectively.

Note that the first to n-th capacitors 206(1) to 206(*n*) are not necessarily provided. In FIG. 5, one of two electrodes of each of the first to n-th capacitors 206(1) to 206(*n*) is connected to the gate of each of the first to n-th driving transistors 203(1) to 203(*n*), and the other thereof is connected to the power supply line Vi.

Furthermore, although the pixel in FIG. 5 includes the first to n-th data selecting transistors 204(1) to 204(*n*), the number of data selecting transistors is not limited to n in FIG. 5 so long as it is n or more per pixel. In addition, although the first to n-th data selecting transistors 204(1) to 204(*n*) are P-channel types in FIG. 5, the invention is not limited to this configuration. Alternatively, the first to n-th data selecting transistors 204(1) to 204(*n*) may be N-channel types. In the case where the gates of the plurality of data selecting transistors are connected to different selecting lines respectively, the conductivity of the plurality of data selecting transistors may be the same or different.

In addition, although the first to n-th switching transistors 202(1) to 202(*n*) are N-channel types in FIG. 5, the invention is not limited to this configuration so long as they have the same conductivity. Therefore, the first to n-th switching transistors 202(1) to 202(*n*) may be P-channel types. However, in the case where the gates of the plurality of switching transistors in the pixel are connected to different scan lines respectively, all the switching transistors may not necessarily have the same conductivity.

Furthermore, although the first to n-th driving transistors 203(1) to 203(*n*) are P-channel types in FIG. 5, the invention is not limited to this configuration. The first to n-th driving transistors 203(1) to 203(*n*) may be N-channel types. Note that in the case where the first to n-th driving transistors 203(1) to 203(*n*) are P-channel types, it is preferable that the first electrode of the light emitting element 201 be an anode while the second electrode thereof be a cathode. Whereas, in the case where the first to n-th driving transistors 203(1) to 203(*n*) are N-channel types, it is preferable that the first electrode of the light emitting element 201 be a cathode while the second electrode thereof be an anode.

Figure 6:
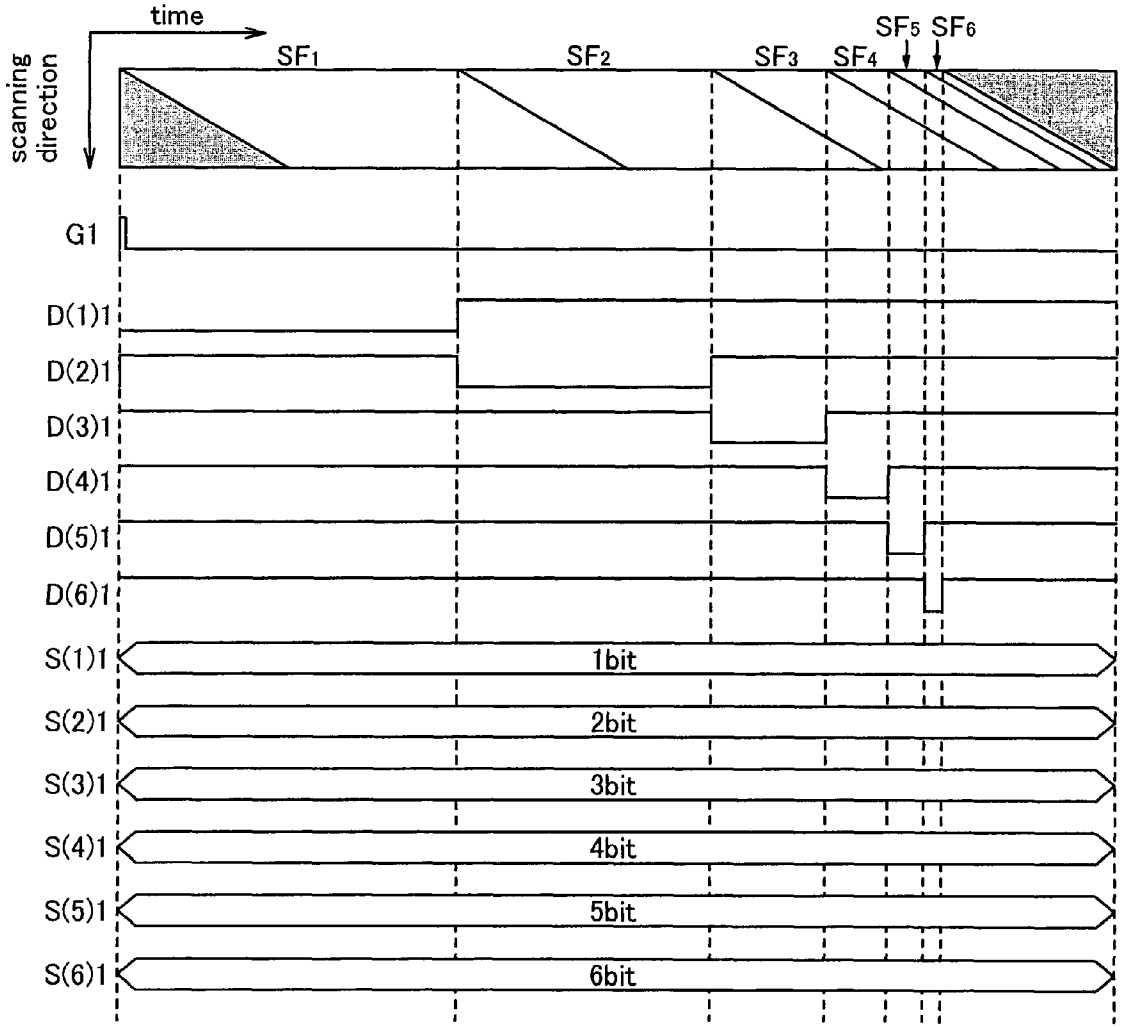
FIG. 6 is timing charts illustrating operation of the pixel shown in FIG. 5 where n=6.

FIG. 6 is a timing chart in the case of a 6-bit gray scale display using the pixel shown in FIG. 5 where n=6. In FIG. 6, the horizontal axis indicates the length of subframe periods ($SF_1$ to $SF_6$) within one frame period, and the vertical axis indicates the selection sequence of scan lines. In the case where 64 gray scales are displayed using a 6-bit video signal, at least 6 subframe periods are required. In addition, in the case where the gray level is varied linearly, the length ratio of the six subframe periods ($SF_1$ to $SF_6$) is set to be $2^5$: $2^4$: $2^3$: $2^2$: $2^1$: $2^0$.

In FIG. 6, timing charts of signals inputted into the scan line G1 and the first to sixth selecting lines D(1)1 to D(6)1 in each of the subframe periods are shown respectively. Timing of signals inputted into the first to sixth signal lines S(1)1 to S(6) are also shown respectively.

In FIG. 6, 6 bits of video signals are all inputted into pixels from the first row in a writing period. Therefore, the subframe periods $SF_1$ to $SF_6$ can appear sequentially after one writing period terminates.

As shown in FIG. 6, in the case where all bits are inputted into pixels in one writing period, display can be performed without providing a non-display period. Consequently, duty ratio can be increased, and the image contrast displayed in the pixel portion can be enhanced.

Note that, although FIG. 6 is timing charts in the case of a 6-bit gray scale display using six subframe periods, the invention is not limited to this. By dividing a longer subframe period into a plurality of frames, the total number of subframe periods and divided subframe periods may be increased to more than six to perform display.

Moreover, note that although in this embodiment mode, between the power supply line Vi and the second electrode of the light emitting element 101, voltage is applied so as to supply forward biased current to the light emitting element 101 when the power supply line Vi and the second electrode of the light emitting element 101 are electrically connected. However, the invention is not limited to this. Current supply to the light emitting element 101 may be stopped until a writing period terminates at all rows. Specifically, it is preferable that the potential difference between the power supply line Vi and the second electrode of the light emitting element 101 be close to 0. Alternatively, assuming the light emitting element 101 as a diode here, the potential difference between the power supply line Vi and the second electrode of the light emitting element 101 is preferably set such that reverse biased voltage can be applied between a pair of electrodes of the light emitting element 101. Alternatively, a current flow path to the light emitting element 101 may be interrupted using a switch and the like.

Figure 16:
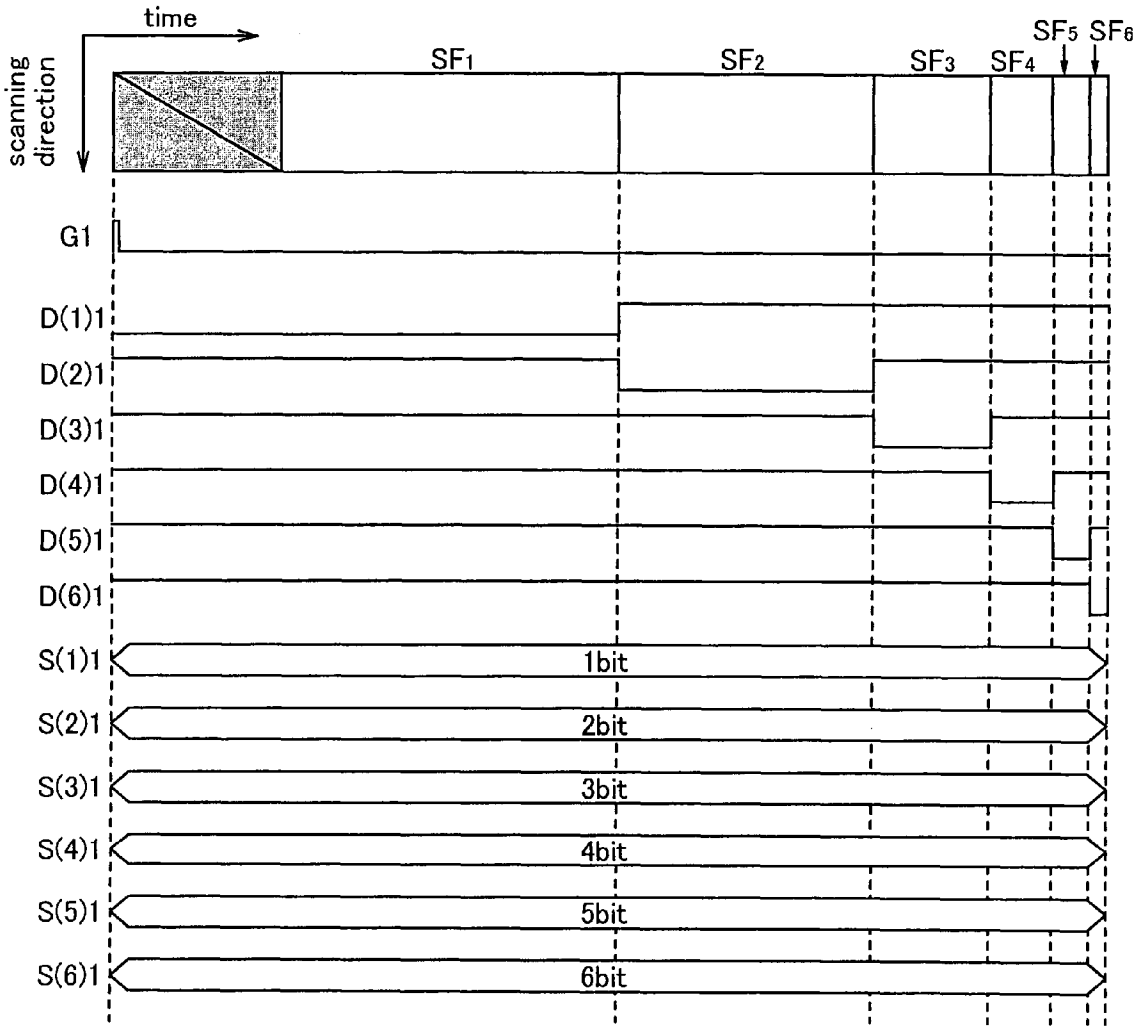
FIG. 16 is timing charts illustrating operation of the pixel shown in FIG. 5 where n=6.

FIG. 16 is timing charts in the case of a 6-bit gray scale display using the pixel shown in FIG. 5 where n=6. It is to be noted here that current supply to the light emitting element 101 is stopped until a writing period terminates at all rows. In FIG. 16, the horizontal axis indicates the length of subframe periods ($SF_1$ to $SF_6$) within one frame period, and the vertical axis indicates the selection sequence of scan lines.

According to a driving method illustrated in FIG. 16, pixels at all rows can be displayed concurrently in each of the subframe periods.

Note that, although FIG. 16 is timing charts in the case of a 6-bit gray scale display using six subframe periods, the invention is not limited to this. By dividing a longer subframe period into a plurality of frames, the total number of subframe periods and divided subframe periods may be increased to more than six to perform display.

Embodiment 1

In this embodiment, a layout of a pixel in a light emitting device of the invention is described. Note that in this embodiment, a pixel in FIG. 1 where the first capacitor 106(1) and the second capacitor 106(2) are not provided is described as an example.

Figure 9:
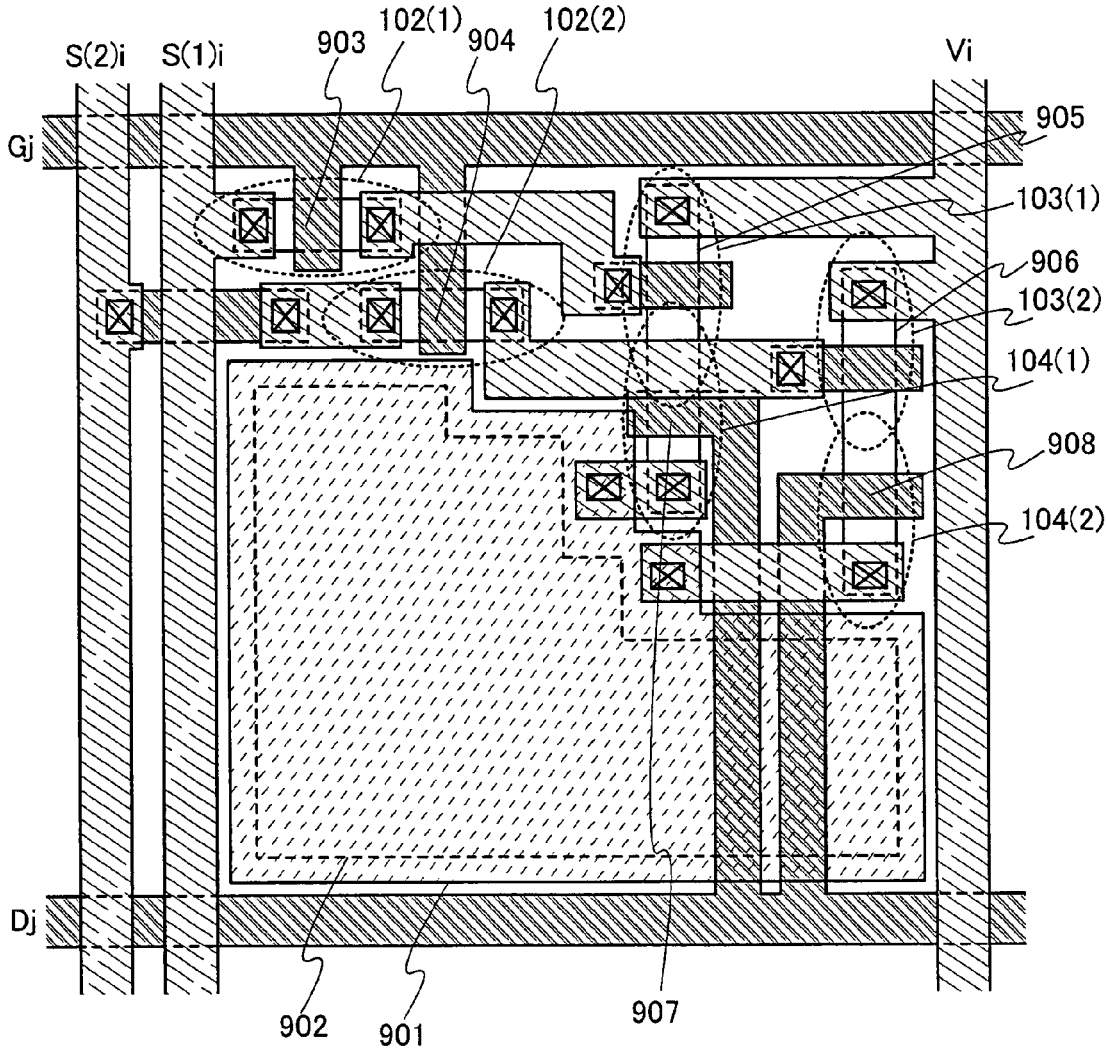
FIG. 9 is a top view of the pixel shown in FIG. 1.

A top view of the pixel shown in FIG. 1 is illustrated in FIG. 9. In FIG. 9, the scan line Gj partially functions as a gate 903 of the first switching transistor 102(1) and a gate 904 of the second switching transistor 102(2).

In addition, the first driving transistor 103(1) and the first data selecting transistor 104(1) share an active layer 905 while the second driving transistor 103(2) and the second data selecting transistor 104(2) share an active layer 906 in FIG. 9.

The selecting line Dj partially functions as a gate 907 of the first data selecting transistor 104(1) and a gate 908 of the second data selecting transistor 104(2) in FIG. 9.

Note that as for the light emitting element 101, a first electrode 901 and a region 902 where the first electrode 901 overlaps the electroluminescent layer and a second electrode are shown in FIG. 9.

Embodiment 2

Figure 10:
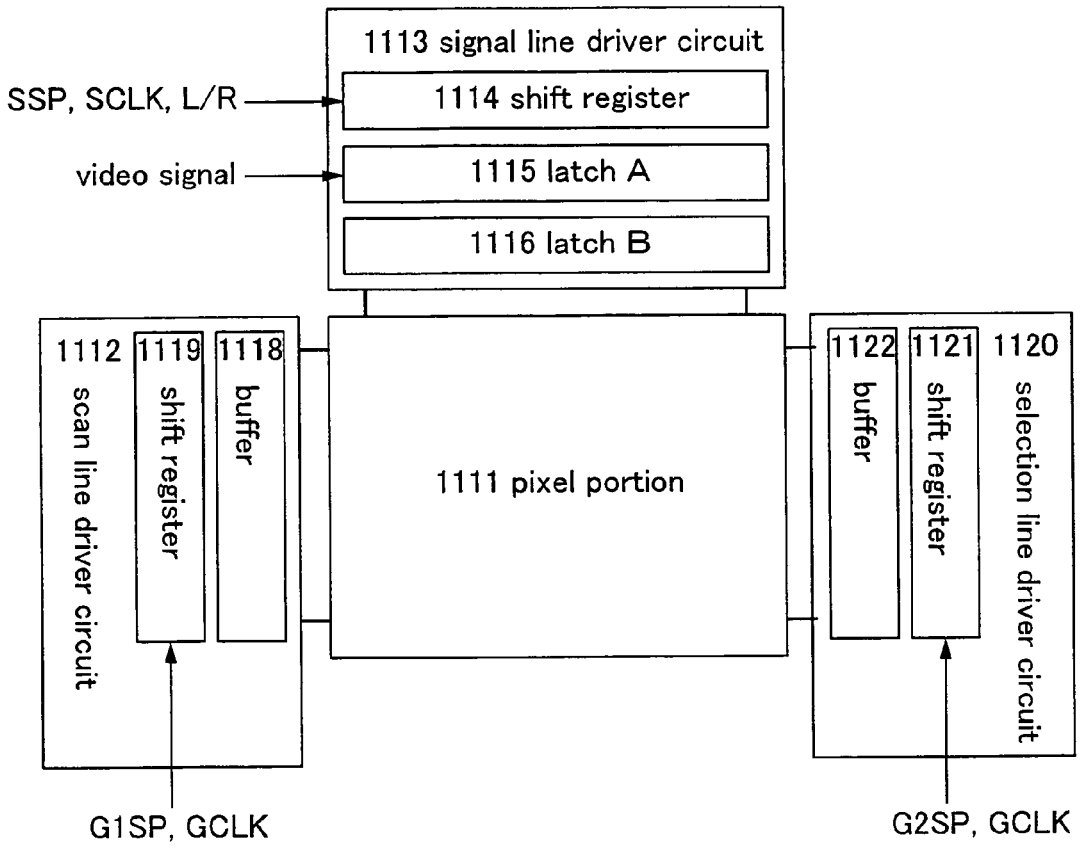
FIG. 10 is a block diagram illustrating constitution of driver circuits in the light emitting device of the invention.

In this embodiment, driver circuits employed in the light emitting device of the invention are described. FIG. 10 is a block diagram of a light emitting device in this embodiment. The light emitting device shown in FIG. 10 comprises a pixel portion 1111 including a plurality of pixels each having a light emitting element, a scan line driver circuit 1112 for selecting each the pixel, a signal line driver circuit 1113 for controlling input of a video signal into the selected pixel, and a selecting line driver circuit 1120 for controlling potential of a selecting line.

In FIG. 10, the signal line driver circuit 1113 includes a shift register 1114, a latch A 1115, and a latch B 1116. A clock signal (SCLK), a start pulse signal (SSP), and a switching-over signal (L/R) are inputted into the shift register 1114. When the clock signal (SCLK) and the start pulse signal (SSP) are inputted, a timing signal is generated in the shift register 1114. According to the switching-over signal (L/R), the order in which pulses of the timing signal appear is switched over. The generated timing signal is inputted into the first-stage latch A 1115 sequentially. When input of the timing signal into the latch A 1115 is completed, a video signal is sequentially inputted into the latch A 1115 in synchronization with a pulse of the inputted timing signal, and held. It is to be noted that, although the video signal is inputted into the latch A 1115 sequentially in this embodiment, the invention is not limited to this structure. Alternatively, division drive, that is, to divide a plurality of stages of the latch A 1115 into several groups and input a video signal in parallel per group may be performed. Note that the number of the groups here is called the dividing number. For example, in the case where the latch is divided into four groups of stages, four-division drive is performed.

The period until video signal input into all of the latch stages of the latch A 1115 is completed is called a row selection period. Practically, there may be a case where a row selection period includes a horizontal retrace period in addition to the aforementioned row selection period.

Then, one row selection period terminates, a latch signal (Latch Signal) is supplied to the second-stage latch B 1116. In synchronization with the latch signal, the video signal held in the latch A 1115 is written all at once into the latch B 1116, and held. When sending of the video signal to the latch B 1116 terminates, the latch A 1115 is inputted with the next video signal according to the timing signal from the shift register 1114 again. During this second one row selection period, the video signal written and held in the latch B 1116 is inputted into the pixel portion 1111.

It is to be noted that instead of the shift register 1114, a circuit such as a decoder which is capable of selecting a signal line may be used.

Next, constitution of the scan line driver circuit 1112 is described. The scan line driver circuit 1112 includes a shift register 1119 and a buffer 1118. Further, a level shifter may be included if necessary. In the scan line driver circuit 1112, a clock (GCLK) and a start pulse signal (G1SP) are inputted into the shift register 1119 to generate a selection signal. The generated selection signal is buffered and amplified in the buffer 1118 to be supplied to the corresponding scan line. The scan line is connected to gates of switching transistors for pixels at one row. Since the switching transistors for pixels at one row are required to be turned ON all at once, a buffer that a large amount of current can be flown is used as the buffer 1118.

Instead of the shift register 1119, a circuit such as a decoder which is capable of selecting a signal line may be used.

Constitution of the selection line driver circuit 1120 is described. The selection line driver circuit 1120 includes a shift register 1121 and a buffer 1122. Further, a level shifter may be included if necessary. In the selection line driver circuit 1120, a clock (GCLK) and a start pulse signal (G2SP) are inputted into the shift register 1121 to generate a selection signal. The generated selection signal is buffered and amplified in the buffer 1122 to be supplied to the corresponding selection line. The selection line is connected to gates of data selecting transistors for pixels at one row. Since the data selecting transistors for pixels at one row are required to be turned ON all at once, a buffer that a large amount of current can be flown is used as the buffer 1122.

Instead of the shift register 1121, a circuit such as a decoder which is capable of selecting a signal line may be used.

Note that the scan line driver circuit 1112, the signal line driver circuit 1113, and the selection line driver circuit 1120 may be formed over the same substrate as the pixel portion 1111, or formed over a different substrate.

Embodiment 3

Figure 11A:
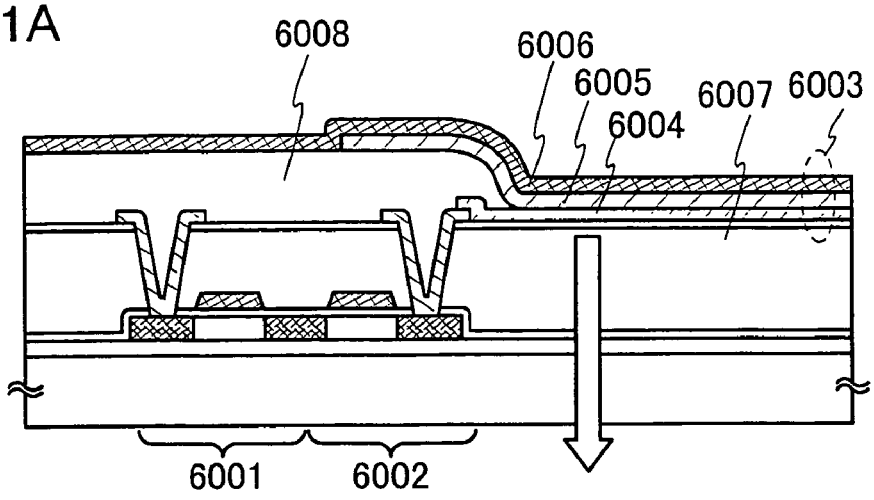
FIGS. 11A to 11C are cross-sectional views of a pixel in the light emitting device of the invention.
Figure 11B:
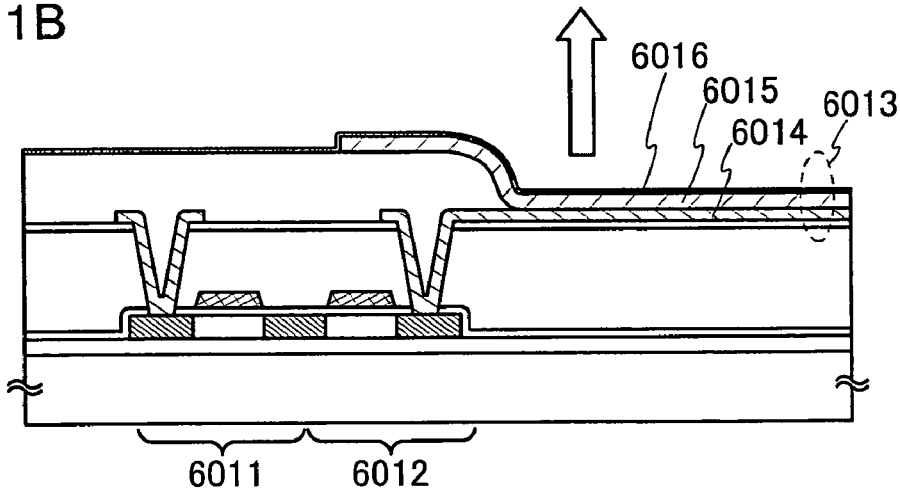
Figure 11C:
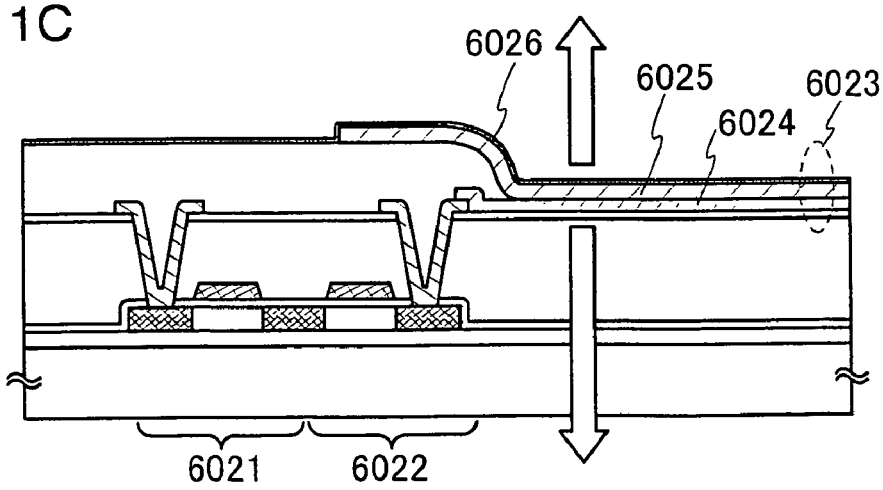

In this embodiment, a cross-sectional structure of a pixel where a driving transistor is a P-channel type is described using FIGS. 11A to 11C. Note that a first electrode is an anode while a second electrode is a cathode in FIGS. 11A to 11C, however, it is possible that the first electrode is a cathode while the second electrode is an anode as well.

FIG. 11A is a cross-sectional view of a pixel where a driving transistor 6001 and a data selecting transistor 6002 are P-channel types and light emitted from a light emitting element 6003 is extracted from a first electrode 6004 side. Although the first electrode 6004 of the light emitting element 6003 is electrically connected to the data selecting transistor 6002 in FIG. 11A, the first electrode 6004 of the light emitting element 6003 may be electrically connected to the driving transistor 6001.

The driving transistor 6001 and the data selecting transistor 6002 are covered with an interlayer insulating film 6007, and a bank 6008 having an opening is formed over the interlayer insulating film 6007. In the opening of the bank 6008, the first electrode 6004 is partially exposed, and the first electrode 6004, an electroluminescent layer 6005 and a second electrode 6006 are stacked in this order.

The interlayer insulating film 6007 can be formed by an organic resin film, an inorganic insulating film, or an insulating film formed of a siloxane material as a starting material and having Si—O—Si bonds (hereinafter referred to as a "siloxane insulating film"). The siloxane insulating film may contain as a substituent at least one of fluorine, an alkyl group and aromatic hydrocarbon in addition to hydrogen. The interlayer insulating film 6007 may also be formed of a so-called low dielectric constant material (low-k material).

The bank 6008 can be formed by using an organic resin film, an inorganic insulating film, or a siloxane insulating film. In the case of an organic resin film, for example, acrylic, polyimide, polyamide and the like can be used, whereas in the case of an inorganic insulating film, silicon oxide, silicon nitride oxide and the like can be used. Preferably, the bank 6008 is formed by using a photosensitive organic resin film and has an opening on the first electrode 6004 which is formed such that the side face thereof has a slope with a continuous curvature, which can prevent the first electrode 6004 and the second electrode 6006 from being short-circuited.

The first electrode 6004 is formed of a material or with a thickness to transmit light, and of a metal suitable for being used as an anode. For example, the first electrode 6004 can be formed of indium tin oxide (ITO), zinc oxide (ZnO), indium zinc oxide (IZO), gallium-doped zinc oxide (GZO), or another light transmitting conductive oxide. Alternatively, the first electrode 6004 may be formed of a mixture of ITO, indium tin oxide containing silicon oxide (hereinafter referred to as ITSO) or indium oxide containing silicon oxide with zinc oxide (ZnO) of 2 to 20%. Further, other than the aforementioned light transmitting conductive oxides, the first electrode 6004 may be formed by using, for example, a single-layer film of one or more of TiN, ZrN, Ti, W, Ni, Pt, Cr, Ag, Al and the like, a laminated layer of a titanium nitride film and a film containing aluminum as a main component, or a three-layer structure of a titanium nitride film, a film containing aluminum as a main component and a titanium nitride film. However, when adopting a material other than the light transmitting conductive oxides, the first electrode 6004 is formed thick enough to transmit light (preferably about 5 to 30 nm).

The second electrode 6006 is formed of a material and with a thickness to reflect or shield light, and can be formed of a metal, an alloy, an electrically conductive compound or a mixture of them each having a low work function. Specifically, an alkali metal such as Li and Cs, an alkaline earth metal such as Mg, Ca and Sr, an alloy containing such metals (Mg:Ag, Al:Li, Mg:In or the like), a compound of such metals ($CaF_2$ or CaN), or a rare-earth metal such as Yb and Er can be employed. When providing an electron injection layer, another conductive layer such as an Al layer can be employed as well.

The electroluminescent layer 6005 is structured by a single layer or a plurality of layers. In the case of a plurality of layers, these layers can be classified into a hole injection layer, a hole transporting layer, a light emitting layer, an electron transporting layer, an electron injection layer and the like in terms of the carrier transporting property. When the electroluminescent layer 6005 has any of the hole injection layer, the hole transporting layer, the electron transporting layer and the electron injection layer in addition to the light emitting layer, the hole injection layer, the hole transporting layer, the light emitting layer, the electron transporting layer and the electron injection layer are stacked in this order on the first electrode 6004. Note that the boundary between the layers is not necessarily distinct, and the boundary can not be distinguished clearly in some cases since the materials forming the respective layers are partially mixed. Each of the layers can be formed of an organic material or an inorganic material. As for an organic material, any of the high, medium and low molecular weight materials can be employed. Note that the medium molecular weight material means a low polymer in which the number of repeated structural units (the degree of polymerization) is about 2 to 20. There is no clear distinction between the hole injection layer and the hole transporting layer, and both of them inevitably have the hole transporting property (hole mobility). The hole injection layer is in contact with the anode, and a layer in contact with the hole injection layer is distinguished as a hole transporting layer for convenience. The same applies to the electron transporting layer and the electron injection layer. A layer in contact with the cathode is called an electron injection layer while a layer in contact with the electron injection layer is called an electron transporting layer. The light emitting layer may combine the function of the electron transporting layer in some cases, and thus may be called a light emitting electron transporting layer.

In the pixel shown in FIG. 11A, light emitted from the light emitting element 6003 can be extracted from the first electrode 6004 side as shown by a hollow arrow.

FIG. 11B is a cross-sectional view of a pixel where a driving transistor 6011 and a data selecting transistor 6012 are P-channel types and light emitted from a light emitting element 6013 is extracted from a second electrode 6016 side. Although the first electrode 6014 of the light emitting element 6013 is electrically connected to the data selecting transistor 6012 in FIG. 11B, the first electrode 6014 of the light emitting element 6013 may be electrically connected to the driving transistor 6011. On the first electrode 6014, an electroluminescent layer 6015 and the second electrode 6016 are stacked in this order.

The first electrode 6014 is formed of a material and with a thickness to reflect or shield light, and formed of a material suitable for being used as an anode. For example, the first electrode 6014 may be formed by a single-layer film of one or more of TiN, ZrN, Ti, W, Ni, Pt, Cr, Ag, Al and the like, a laminated layer of a titanium nitride film and a film containing aluminum as a main component, or a three-layer structure of a titanium nitride film, a film containing aluminum as a main component and a titanium nitride film.

The second electrode 6016 is formed of a material or with a thickness to transmit light, and can be formed of a metal, an alloy, an electrically conductive compound or a mixture of them each having a low work function. Specifically, an alkali metal such as Li and Cs, an alkaline earth metal such as Mg, Ca and Sr, an alloy containing such metals (Mg:Ag, Al:Li, Mg:In or the like), a compound of such metals ($CaF_2$ or CaN), or a rare-earth metal such as Yb and Er can be employed. When providing an electron injection layer, another conductive layer such as an Al layer can be employed as well. Moreover, the second electrode 6016 is formed thick enough to transmit light (preferably about 5 to 30 nm). Note that the second electrode 6016 may be formed of another light transmitting conductive oxide such as indium tin oxide (ITO), zinc oxide (ZnO), indium zinc oxide (IZO), and gallium-doped zinc oxide (GZO). Alternatively, a mixture of ITO, indium tin oxide containing silicon oxide (ITSO) or indium oxide containing silicon oxide with zinc oxide (ZnO) of 2 to 20% may be employed. In the case of adopting a light transmitting conductive oxide, an electron injection layer is preferably provided in the electroluminescent layer 6015.

The electroluminescent layer 6015 can be formed similarly to the electroluminescent layer 6005 shown in FIG. 11A.

In the pixel shown in FIG. 11B, light emitted from the light emitting element 6013 can be extracted from the second electrode 6016 side as shown by a hollow arrow.

FIG. 11C is a cross-sectional view of a pixel where a driving transistor 6021 and a data selecting transistor 6022 are P-channel types and light emitted from a light emitting element 6023 is extracted from a first electrode 6024 side and a second electrode 6026 side. Although the first electrode 6024 of the light emitting element 6023 is electrically connected to the data selecting transistor 6022 in FIG. 11C, the first electrode 6024 of the light emitting element 6023 may be electrically connected to the driving transistor 6021. On the first electrode 6024, an electroluminescent layer 6025 and the second electrode 6026 are stacked in this order.

The first electrode 6024 can be formed similarly to the first electrode 6004 shown in FIG. 11A while the second electrode 6026 can be formed similarly to the second electrode 6016 shown in FIG. 11B. The electroluminescent layer 6025 can be formed similarly to the electroluminescent layer 6005 shown in FIG. 11A.

In the pixel shown in FIG. 11C, light emitted from the light emitting element 6023 can be extracted from both of the first electrode 6024 side and the second electrode 6026 side as shown by hollow arrows.

Embodiment 4

Figure 12A:
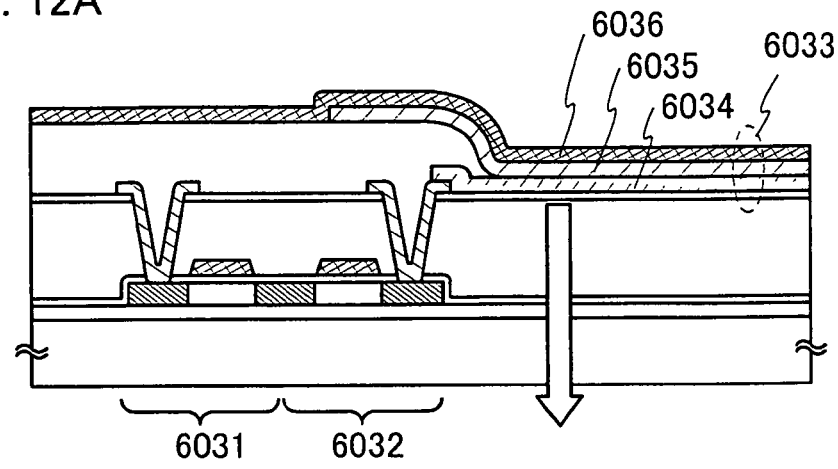
FIGS. 12A to 12C are cross-sectional views of a pixel in the light emitting device of the invention.
Figure 12B:
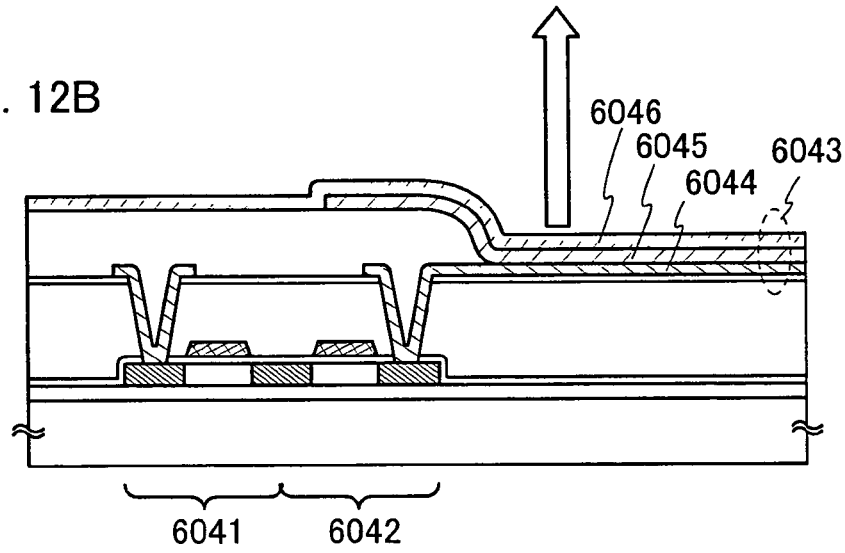
Figure 12C:
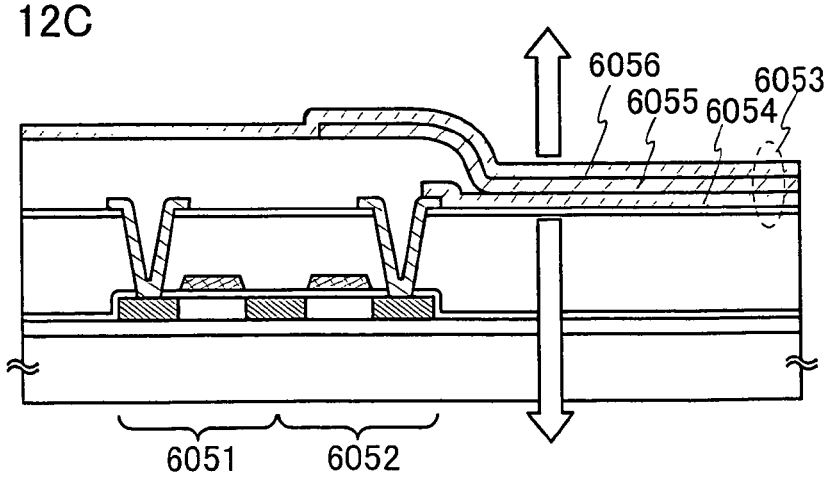

In this embodiment, a cross-sectional structure of a pixel where a driving transistor is an N-channel type is described using FIGS. 12A to 12C. Note that a first electrode is a cathode while a second electrode is an anode in FIGS. 12A to 12C, however, it is possible that the first electrode is an anode while the second electrode is a cathode as well.

FIG. 12A is a cross-sectional view of a pixel where a driving transistor 6031 and a data selecting transistor 6032 are N-channel types and light emitted from a light emitting element 6033 is extracted from a first electrode 6034 side. Although the first electrode 6034 of the light emitting element 6033 is electrically connected to the data selecting transistor 6032 in FIG. 12A, the first electrode 6034 of the light emitting element 6033 may be electrically connected to the driving transistor 6031. On the first electrode 6034, an electroluminescent layer 6035 and the second electrode 6036 are stacked in this order.

The first electrode 6034 is formed of a material or with a thickness to transmit light, and can be formed of a metal, an alloy, an electrically conductive compound or a mixture of them each having a low work function. Specifically, an alkali metal such as Li and Cs, an alkaline earth metal such as Mg, Ca and Sr, an alloy containing such metals (Mg:Ag, Al:Li, Mg:In or the like), a compound of such metals ($CaF_2$ or CaN), or a rare-earth metal such as Yb and Er can be employed. When providing an electron injection layer, another conductive layer such as an Al layer can be employed as well. Moreover, the first electrode 6034 is formed thick enough to transmit light (preferably about 5 to 30 nm). In addition, a translucent conductive layer may be additionally formed using light transmitting conductive oxide so as to contact with the top or bottom of the aforementioned conductive layer having a thickness to transmit light in order to suppress the sheet resistance of the first electrode 6034. Note that the first electrode 6034 may be formed by using only a conductive layer employing indium tin oxide (ITO), zinc oxide (ZnO), indium zinc oxide (IZO), gallium-doped zinc oxide (GZO), or another light transmitting conductive oxide. Alternatively, a mixture of ITO, indium tin oxide containing silicon oxide (ITSO) or indium oxide containing silicon oxide with zinc oxide (ZnO) of 2 to 20% may be employed. In the case of adopting a light transmitting conductive oxide, an electron injection layer is preferably provided in the electroluminescent layer 6035.

The second electrode 6036 is formed of a material and with a thickness to reflect or shield light, and formed of a material suitable for being used as an anode. For example, the second electrode 6036 may be formed by a single-layer film of one or more of TiN, ZrN, Ti, W, Ni, Pt, Cr, Ag, Al and the like, a laminated layer of a titanium nitride film and a film containing aluminum as a main component, or a three-layer structure of a titanium nitride film, a film containing aluminum as a main component and a titanium nitride film.

The electroluminescent layer 6035 can be formed similarly to the electroluminescent layer 6005 shown in FIG. 11A. In the case where the electroluminescent layer 6035 has any of the hole injection layer, the hole transporting layer, the electron transporting layer and the electron injection layer in addition to the light emitting layer, the electron injection layer, the electron transporting layer, the light emitting layer, the hole transporting layer and the hole injection layer are stacked in this order on the first electrode 6034.

In the pixel shown in FIG. 12A, light emitted from the light emitting element 6033 can be extracted from the first electrode 6034 side as shown by a hollow arrow.

FIG. 12B is a cross-sectional view of a pixel where a driving transistor 6041 and a data selecting transistor 6042 are N-channel types and light emitted from a light emitting element 6043 is extracted from a second electrode 6046 side. Although a first electrode 6044 of the light emitting element 6043 is electrically connected to the data selecting transistor 6042 in FIG. 12B, the first electrode 6044 of the light emitting element 6043 may be electrically connected to the driving transistor 6041. On the first electrode 6044, an electroluminescent layer 6045 and the second electrode 6046 are stacked in this order.

The first electrode 6044 is formed of a material and with a thickness to reflect or shield light, and can be formed of a metal, an alloy, an electrically conductive compound or a mixture of them each having a low work function. Specifically, an alkali metal such as Li and Cs, an alkaline earth metal such as Mg, Ca and Sr, an alloy containing such metals (Mg:Ag, Al:Li, Mg:In or the like), a compound of such metals ($CaF_2$ or CaN), or a rare-earth metal such as Yb and Er can be employed. When providing an electron injection layer, another conductive layer such as an Al layer can be employed as well.

The second electrode 6046 is formed of a material or with a thickness to transmit light, and formed of a material suitable for being used as an anode. For example, the second electrode 6046 can be formed of indium tin oxide (ITO), zinc oxide (ZnO), indium zinc oxide (IZO), gallium-doped zinc oxide (GZO), or another light transmitting conductive oxide. Alternatively, the second electrode 6046 may be formed of a mixture of ITO, indium tin oxide containing silicon oxide (ITSO) or indium oxide containing silicon oxide with zinc oxide (ZnO) of 2 to 20%. Further, other than the aforementioned light transmitting conductive oxides, the second electrode 6046 may be formed by, for example, a single-layer film of one or more of TiN, ZrN, Ti, W, Ni, Pt, Cr, Ag, Al and the like, a laminated layer of a titanium nitride film and a film containing aluminum as a main component, or a three-layer structure of a titanium nitride film, a film containing aluminum as a main component and a titanium nitride film. However, when adopting a material other than the light transmitting conductive oxides, the second electrode 6046 is formed thick enough to transmit light (preferably about 5 to 30 nm).

The electroluminescent layer 6045 can be formed similarly to the electroluminescent layer 6035 shown in FIG. 12A.

In the pixel shown in FIG. 12B, light emitted from the light emitting element 6043 can be extracted from the second electrode 6046 side as shown by a hollow arrow.

FIG. 12C is a cross-sectional view of a pixel where a driving transistor 6051 and a data selecting transistor 6052 are N-channel types and light emitted from a light emitting element 6053 is extracted from a first electrode 6054 side and a second electrode 6056 side. Although the first electrode 6054 of the light emitting element 6053 is electrically connected to the data selecting transistor 6052 in FIG. 12C, the first electrode 6054 of the light emitting element 6053 may be electrically connected to the driving transistor 6051. On the first electrode 6054, an electroluminescent layer 6055 and the second electrode 6056 are stacked in this order.

The first electrode 6054 can be formed similarly to the first electrode 6034 shown in FIG. 12A while the second electrode 6056 can be formed similarly to the second electrode 6046 shown in FIG. 12B. The electroluminescent layer 6055 can be formed similarly to the electroluminescent layer 6035 shown in FIG. 12A.

In the pixel shown in FIG. 12C, light emitted from the light emitting element 6053 can be extracted from both of the first electrode 6054 side and the second electrode 6056 side as shown by hollow arrows.

Embodiment 5

The light emitting device of the invention can be manufactured by a printing method typified by screen printing and offset printing, or a droplet discharging method. The droplet discharging method is a method for forming a predetermined pattern by discharging droplets containing a predetermined composition from an orifice, which includes an ink-jet method. When using such printing method or droplet discharging method, various wirings typified by a signal line, a scan line, and a selection line, a gate of a TFT, an electrode of a light emitting element, and the like can be formed without employing a mask for exposure. However, the printing method or the droplet discharging method is not necessarily used for the whole steps of forming patterns. Therefore, such process is possible that wirings and a gate are formed by a printing method or a droplet discharging method while a semiconductor film is patterned by a lithography method, in which case the printing method or the droplet discharging method are used for a part of the steps, and a lithography method is additionally used. Note that a mask for patterning may be formed by a printing method or a droplet discharging method.

Figure 13:
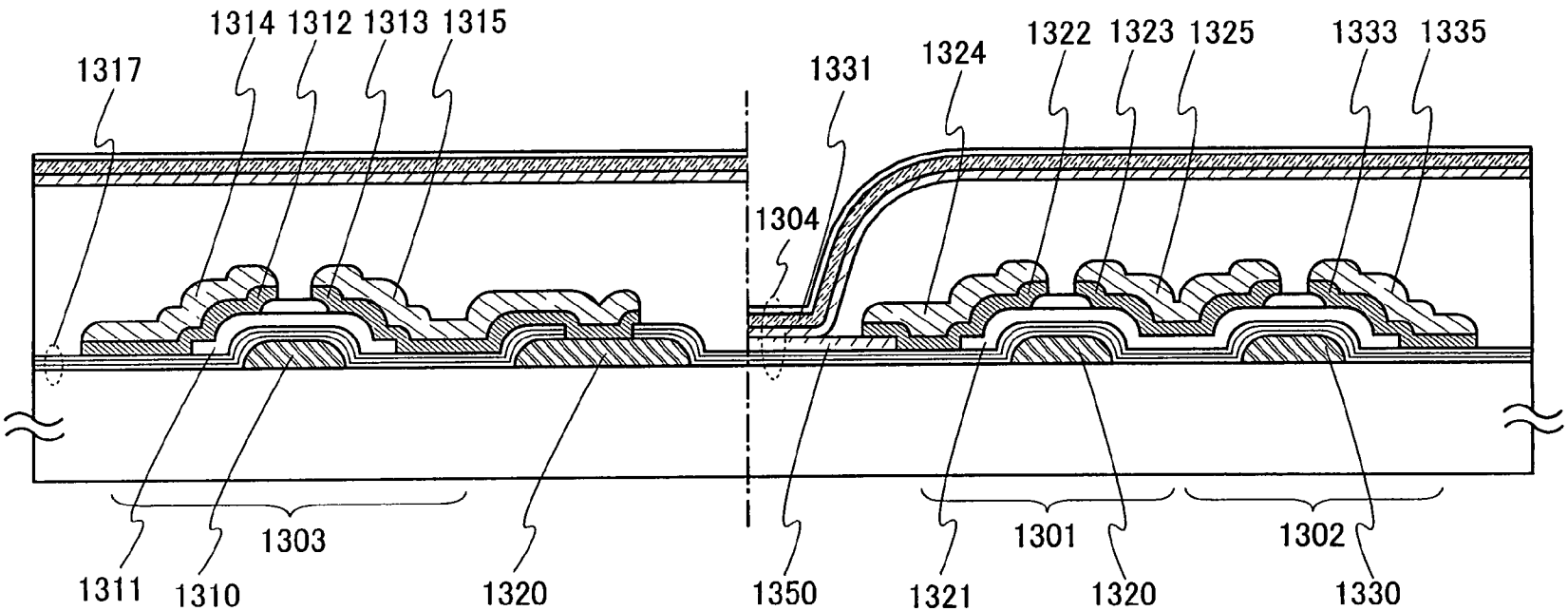
FIG. 13 is a cross-sectional view of a pixel in the light emitting device of the invention.

FIG. 13 is an exemplary cross-sectional view of a light emitting device of the invention formed using a droplet discharging method. In FIG. 13, reference numeral 1301 denotes a data selecting transistor, 1302 denotes a driving transistor, 1303 denotes a switching transistor and 1304 denotes a light emitting element. Note that the data selecting transistor 1301 is electrically connected to a first electrode 1350 of the light emitting element 1304 in FIG. 13, however, the invention is not limited to this structure. The driving transistor 1302 may be electrically connected to the first electrode 1350 of the light emitting element 1304. The driving transistor 1302 is preferably an N-channel type, and in that case it is preferable that the first electrode 1350 be a cathode while a second electrode 1331 be an anode.

The switching transistor 1303 has a gate 1310, a first semiconductor film 1311 including a channel formation region, a gate insulating film 1317 formed between the gate 1310 and the first semiconductor film 1311, second semiconductor films 1312 and 1313 functioning as a source or a drain, a wiring 1314 connected to the second semiconductor film 1312, and a wiring 1315 connected to the second semiconductor film 1313.

The data selecting transistor 1301 has a gate 1320, a first semiconductor film 1321 including a channel formation region, the gate insulating film 1317 formed between the gate 1320 and the first semiconductor film 1321, second semiconductor films 1322 and 1323 functioning as a source or a drain, a wiring 1324 connected to the second semiconductor film 1322, and a wiring 1325 connected to the second semiconductor film 1323.

The driving transistor 1302 has a gate 1330, the first semiconductor film 1321 including a channel formation region, the gate insulating film 1317 formed between the gate 1330 and the first semiconductor film 1321, second semiconductor films 1323 and 1333 functioning as a source or a drain, the wiring 1325 connected to the second semiconductor film 1323, and a wiring 1335 connected to the second semiconductor film 1333.

The wiring 1314 corresponds to a signal line, and the wiring 1315 is electrically connected to the gate 1320 of the data selecting transistor 1301. The wiring 1335 corresponds to a power supply line, and the gate 1330 is electrically connected to the power supply line though not shown.

By forming patterns using a droplet discharging method or a printing method, a series of steps for a lithography method that includes photoresist formation, exposure, development, etching, and a peeling can be simplified. In addition, when adopting the droplet discharging method or the printing method, waste of materials that would be removed by etching can be avoided differently from the case of adopting a lithography method. Further, since an expensive mask for exposure is not required, manufacturing cost of the light emitting device can be suppressed.

In addition, differently from a lithography method, etching is not required in order to form wirings. Accordingly, a step of forming wirings can be completed in an extremely shorter time than the case of the lithography method. In particular, when the wiring is formed with a thickness of 0.5 μm or more, and more preferably 2 μm or more, the wiring resistance can be suppressed, therefore, time required for the step of forming wirings can be suppressed while suppressing the increase of the wiring resistance along with enlargement of the light emitting device.

Note that the first semiconductor films 1311 and 1321 may be either an amorphous semiconductor or a semi-amorphous semiconductor (SAS).

Amorphous semiconductors can be obtained by decomposing a silicon gas by glow discharge. As the typical silicon gas, $SiH_4$ or $Si_2H_6$ can be employed. The silicon gas may be diluted with hydrogen, or hydrogen and helium.

Similarly, SAS can be obtained by decomposing a silicon gas by glow discharge. As the typical silicon gas, $SiH_4$ can be used as well as $Si_2H_6$, $SiH_2Cl_2$, $SiHCl_3$, $SiCl_4$ or $SiF_4$. SAS can be formed with ease by diluting the silicon gas with a hydrogen gas or a mixed gas of hydrogen and one or more of a noble-gas element selected among helium, argon, krypton and neon. The silicon gas is preferably diluted to a rate of 2 to 1000 times. Further, the silicon gas may be mixed with a carbon gas such as $CH_4$ and $C_2H_6$, a germanium gas such as $GeH_4$ and $GeF_4$, or $F_2$ so that the energy bandwidth may be controlled to be 1.5 to 2.4 eV or 0.9 to 1.1 eV. A TFT using SAS as the first semiconductor film can exhibit the mobility of 1 to 10 $cm^2$/Vsec or more.

In addition, the first semiconductor films 1311 and 1321 may be formed of a semiconductor obtained by crystallizing an amorphous semiconductor or a semi-amorphous semiconductor (SAS) with laser.

Embodiment 6

Figure 14A:
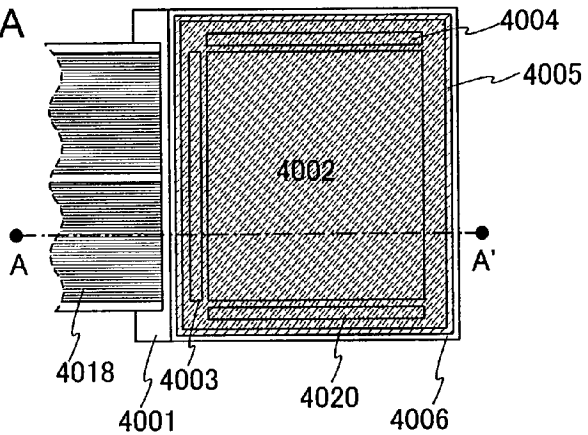
FIGS. 14A and 14B are a top view and a cross-sectional view of the light emitting device of the invention respectively.
Figure 14B:
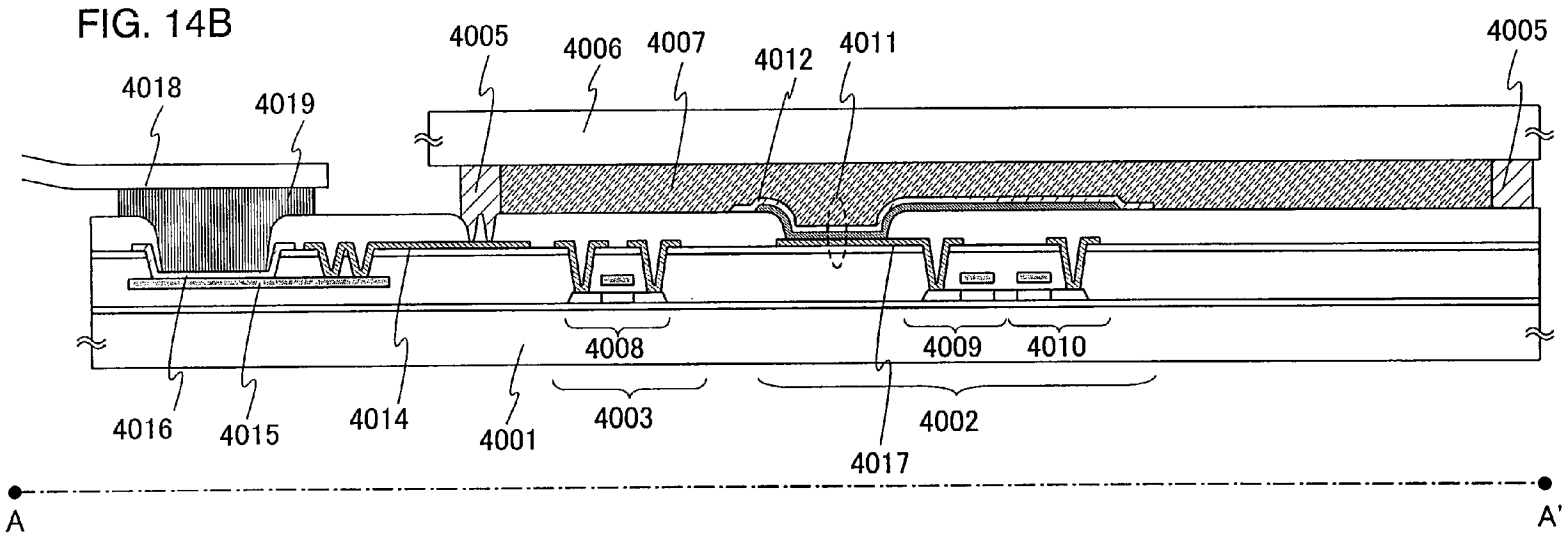

In this embodiment, description is made on an exterior view of a panel which corresponds to one mode of a light emitting device of the invention with reference to FIGS. 14A and 14B. FIG. 14A is a top view of a panel where a first substrate over which transistors and light emitting elements are formed and a second substrate are sealed with a sealant. FIG. 14B is a cross-sectional view of FIG. 14A along a line A-A'.

A sealant 4005 is provided so as to surround a pixel portion 4002, a signal line driver circuit 4003, a scan line driver circuit 4004 and a selection line driver circuit 4020 formed over a first substrate 4001. In addition, over the pixel portion 4002, the signal line driver circuit 4003, the scan line driver circuit 4004 and the selection line driver circuit 4020, a second substrate 4006 is provided. Accordingly, the pixel portion 4002, the signal line driver circuit 4003, the scan line driver circuit 4004 and the selection line driver circuit 4020 are tightly sealed by the first substrate 4001, the sealant 4005 and the second substrate 4006 together with a filler 4007.

The pixel portion 4002, the signal line driver circuit 4003, the scan line driver circuit 4004 and the selection line driver circuit 4020 formed over the first substrate 4001 each includes a plurality of transistors. In FIG. 14B, a transistor 4008 in the signal line driver circuit 4003, and a driving transistor 4009 and a data selecting transistor 4010 in the pixel portion 4002 are illustrated.

Reference numeral 4011 denotes a light emitting element, and a wiring 4017 connected to a drain of the driving transistor 4009 functions partially as a first electrode of the light emitting element 4011. A transparent conductive film 4012 functions as a second electrode of the light emitting element 4011. Note that the light emitting element 4011 is not limited to the structure described in this embodiment, and the structure thereof can be appropriately changed in accordance with the direction of light emitted from the light emitting element 4011, the conductivity of the driving transistor 4009, and the like.

Although the driving transistor 4009 is connected to the first electrode of the light emitting element 4011 in this embodiment, the data selecting transistor 4010 may be connected to the first electrode of the light emitting element 4011.

Signals and voltage supplied to the signal line driver circuit 4003, the scan line driver circuit 4004 and the pixel portion 4002 are supplied from a connecting terminal 4016 via lead wirings 4014 and 4015 though not shown in the cross-sectional view in FIG. 14B.

In this embodiment, the connecting terminal 4016 is formed of the same conductive film as the first electrode of the light emitting element 4011. The lead wiring 4014 is formed of the same conductive film as the wiring 4017. The lead wiring 4015 is formed of the same conductive film as respective gates of the driving transistor 4009 and the transistor 4008.

The connecting terminal 4016 is electrically connected to a terminal of an FPC 4018 through an anisotropic conductive film 4019.

Note that the first substrate 4001 and the second substrate 4006 may be each formed of glass, metal (typically, stainless), ceramics, or plastics. As for the plastic, an FRP (Fiberglass-Reinforced Plastics) substrate, an RVF (Polyvinylfluoride) film, a mylar film, a polyester film or an acrylic resin film can be employed. In addition, a sheet having a structure that aluminum is sandwiched by a PVF film or a mylar film can be employed.

Note that the second substrate 4006 is required to transmit light since it is disposed on the side from which light emitted from the light emitting element 4011 is extracted. In this case, a light transmitting material is employed such as a glass substrate, a plastic substrate, a polyester film and an acrylic film.

As for the filler 4007, an inert gas such as nitrogen and argon, an ultraviolet curable resin or a heat curable resin can be used, and for example, PVC (polyvinyl chloride), acrylic, polyimide, an epoxy resin, a silicone resin, PVB (polyvinyl butyral) or EVA (ethylene vinyl acetate) can be used. In this embodiment, nitrogen is employed as the filler.

This embodiment can be implemented in free combination with any of Embodiments 1 to 5.

Embodiment 7

The light emitting device of the invention can, for example, prevent a pseudo contour and enhance the contrast, which is suitable for an electronic apparatus having a display portion for image display such as a display device and a goggle type display.

Further, the light emitting device of the invention can be applied to such electronic apparatuses as a video camera, a digital camera, a goggle type display (head mounted display), a navigation system, a sound reproducing device (car audio system, audio component system and the like), a notebook personal computer, a game machine, a portable information terminal (mobile computer, portable phone, portable game machine, electronic book and the like), an image reproducing device equipped with a recording medium (typically, a device reproducing a recording medium such as DVD: Digital Versatile Disk, and having a display for displaying the reproduced image). Specific examples of such electronic apparatuses are illustrated in FIGS. 15A to 15C.

Figure 15A:
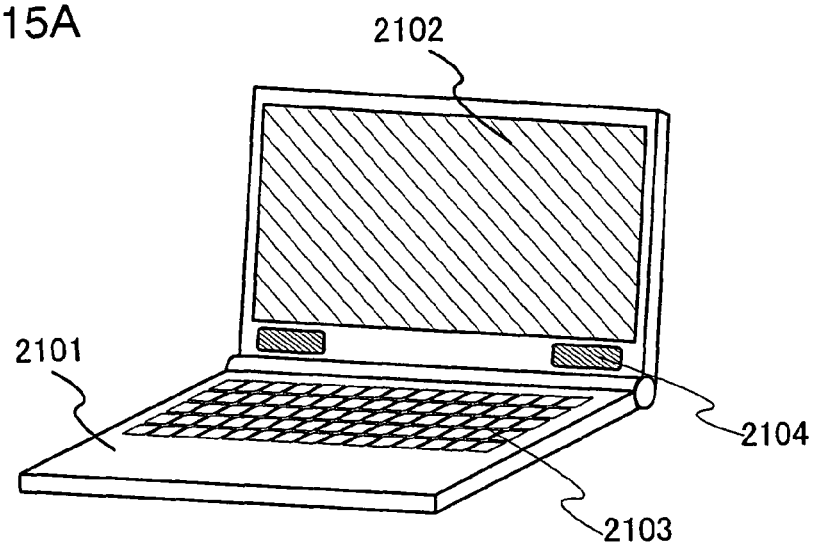
FIGS. 15A to 15C are views of electronic apparatuses to which the light emitting device of the invention is applied.

FIG. 15A illustrates a portable information terminal (PDA) which includes a main body 2101, a display portion 2102, an operating key 2103, a speaker portion 2104 and the like. The light emitting device of the invention can be applied to the display portion 2102.

Figure 15B:
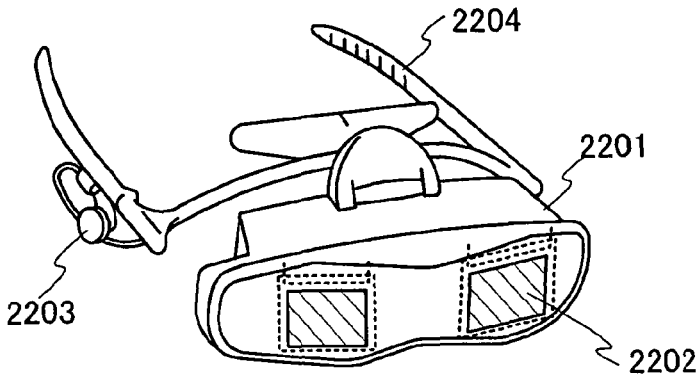

FIG. 15B illustrates a goggle type display device which includes a main body 2201, a display portion 2202, an earphone 2203, a supporting portion 2204 and the like. The light emitting device of the invention can be applied to the display portion 2202. The supporting portion 2204 may be of a type for fixing the goggle type display device on the user's head or a type for fixing it on another portion of user's body other than the head.

Figure 15C:
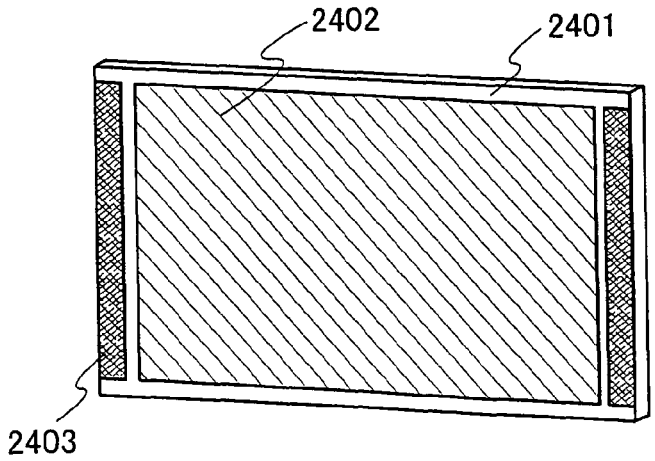

FIG. 15C illustrates a display device which includes a housing 2401, a display portion 2402, a speaker portion 2403 and the like. The light emitting device of the invention can be applied to the display portion 2402. Since the light emitting device is of a self-luminous type, no backlight is required, and a thinner display portion can be provided than that of liquid crystal displays. Note that the display device includes any display device for displaying information such as for computer, for TV broadcast reception, for advertisement display and the like. In the case of adopting a light emitting device for the display device, a polarizer may be provided in order to prevent images from being displayed like mirror images due to the external light reflected on the first electrode or the second electrode of the light emitting element.

As set forth above, the application range of the invention is so wide that it can be applied to electronic apparatuses in various fields. The electronic apparatuses of this embodiment can adopt any of the light emitting devices described in Embodiments 1 to 6.

This application is based on Japanese Patent Application serial no. 2004-133712 filed in Japan Patent Office on 28th, Apr., 2004, the entire contents of which are hereby incorporated by reference.

What is claimed is:

1. A light emitting device comprising:

a first driver circuit for controlling switching between an on state and an off state of first and second switching transistors, the first driver circuit comprising a first shift register;

a second driver circuit for controlling switching between an on state and an off state of first and second data selecting transistors, the second driver circuit comprising a second shift register;

a third driver circuit; and a pixel comprising:

a light emitting element;

the first switching transistor and the second switching transistor for controlling a video signal input into the pixel;

a first driving transistor and a second driving transistor whose gate voltages are controlled by the inputted video signal;

the first data selecting transistor for controlling supply of drain current of the pixel's first driving transistor to the light emitting element; and the second data selecting transistor for controlling supply of drain current of the pixel's second driving transistor to the light emitting element, wherein gates of the pixel's first and the second data selecting transistors are electrically connected to a same selection line, wherein the pixel's first and the second data selecting transistors have different polarity from each other, wherein one of a source and a drain of the first data selecting transistor is electrically connected to one of a source and a drain of the first driving transistor, and the other one of the source and the drain of the first data selecting transistor is electrically connected to the light emitting element, wherein one of a source and a drain of the second data selecting transistor is electrically connected to one of a source and a drain of the second driving transistor, and the other one of the source and the drain of the second data selecting transistor is electrically connected to the light emitting element, wherein the third driver circuit is configured to input one bit of the video signal into a gate of the first driving transistor and another bit of the video signal into a gate of the second driving transistor in a first writing operation in one frame period and to input the one bit of the video signal into the gate of the first driving transistor in a second writing operation in the one frame period, and wherein the second driver circuit is configured to switch the first data selecting transistor from an on state to an off state and the second data selecting transistor from an off state to an on state during a transition from the first writing operation to the second writing operation.

2. The light emitting device according to claim 1, wherein the two driving transistors have the same polarity.

3. The light emitting device according to claim 1, wherein the light emitting device is applied to an electronic apparatus selected from the group consisting of a portable information terminal, a goggle type display device, a computer, a TV broadcast reception and an advertisement display.

4. A display device comprising:

a first driver circuit for outputting a first signal into a first line, the first driver circuit comprising a first shift register;

a second driver circuit for outputting a second signal into a second line, the second driver circuit comprising a second shift register;

a third driver circuit; and a pixel comprising:

a first transistor;

a second transistor;

a third transistor;

a fourth transistor;

a fifth transistor; and a sixth transistor, wherein one of a source and a drain of the first transistor is electrically connected to a gate of the third transistor, one of a source and a drain of the second transistor is electrically connected to a gate of the fourth transistor, one of a source and a drain of the third transistor is electrically connected to one of a source and a drain of the fifth transistor, one of a source and a drain of the fourth transistor is electrically connected to one of a source and a drain of the sixth transistor, and the other one of the source and the drain of the fifth transistor and the other one of the source and the drain of the sixth transistor are electrically connected to a pixel electrode, wherein a gate of the fifth transistor and a gate of the sixth transistor are electrically connected to the first line, wherein a gate of the first transistor and a gate of the second transistor are electrically connected to the second line, wherein the fifth transistor and the sixth transistor have different polarity from each other, wherein the third driver circuit is configured to input one bit of a video signal into the gate of the third transistor and another bit of the video signal into the gate of the fourth transistor in a first writing operation in one frame period and to input the one bit of the video signal into the gate of the third transistor in a second writing operation in the one frame period, and wherein the first driver circuit is configured to switch the fifth transistor from an on state to an off state and the sixth transistor from an off state to an on state during a transition from the first writing operation to the second writing operation.

5. The display device according to claim 4 further comprising:

a first capacitor electrically connected between the gate of the third transistor and the third line; and a second capacitor electrically connected between the gate of the fourth transistor and the third line.

6. The display device according to claim 4, wherein the third transistor and the fourth transistor have the same polarity.

* * * * *